US011871801B1

(12) United States Patent
Ratcliff

(10) Patent No.: US 11,871,801 B1
(45) Date of Patent: Jan. 16, 2024

(54) MULTI-CONFIGURATION BRA

(71) Applicant: Susan J. Ratcliff, Lauderhill, FL (US)

(72) Inventor: Susan J. Ratcliff, Lauderhill, FL (US)

( * ) Notice: Subject to any disclaimer, the term of this patent is extended or adjusted under 35 U.S.C. 154(b) by 0 days.

(21) Appl. No.: 17/530,134

(22) Filed: Nov. 18, 2021

Related U.S. Application Data

(63) Continuation of application No. 16/392,014, filed on Apr. 23, 2019, now Pat. No. 11,178,918, which is a continuation of application No. 13/867,355, filed on Apr. 22, 2013, now Pat. No. 10,264,826, which is a continuation of application No. 12/749,762, filed on Mar. 30, 2010, now Pat. No. 8,425,274.

(60) Provisional application No. 61/165,165, filed on Mar. 31, 2009.

(51) Int. Cl.

| | |
|---|---|
| ***A41C 3/12*** | (2006.01) |
| ***A44C 5/00*** | (2006.01) |
| ***A41C 3/00*** | (2006.01) |
| ***A44C 15/00*** | (2006.01) |

(52) U.S. Cl.
CPC ..... *A41C 3/12* (2013.01); *A41C 3/0028* (2013.01); *A44C 5/00* (2013.01); *A44C 15/005* (2013.01); *A44C 15/009* (2013.01)

(58) Field of Classification Search
CPC ..... A41C 3/12; A41C 3/0028; A41C 5/00; A44C 15/005; A44C 15/009
USPC ..... 450/58, 86
See application file for complete search history.

(56) References Cited

U.S. PATENT DOCUMENTS

| | | | | |
|---|---|---|---|---|
| 2,882,905 | A * | 4/1959 | Barg | A41C 3/02 450/71 |
| 2,954,031 | A * | 9/1960 | Froehlich | A41C 3/06 450/48 |
| 4,161,806 | A * | 7/1979 | Hennisse | A41F 1/006 24/594.11 |
| 5,380,238 | A * | 1/1995 | Crew-Gee | A44B 11/263 24/616 |
| 6,994,606 | B2 * | 2/2006 | Li | A41F 15/002 450/82 |
| 8,425,274 | B1 * | 4/2013 | Ratcliff | A41C 3/12 450/86 |
| 9,462,833 | B1 * | 10/2016 | Spaulding | A41D 7/005 |
| 9,565,881 | B2 * | 2/2017 | Lockyer | A41F 1/006 |
| 9,578,911 | B2 * | 2/2017 | Fildan | A41F 1/006 |
| 10,264,826 | B1 * | 4/2019 | Ratcliff | A44C 15/009 |
| 11,178,918 | B1 * | 11/2021 | Ratcliff | A41C 3/0028 |
| 2003/0003844 | A1 * | 1/2003 | Jones | A41F 15/002 450/88 |

(Continued)

*Primary Examiner* — Gloria M Hale
(74) *Attorney, Agent, or Firm* — Nutter McClennen & Fish LLP

(57) ABSTRACT

A sectional bra system and accessories includes bra and related jewelry components that can be interconnected in various ways. Jewelry items, such as bra straps, back bands, bridge, and other items, may be formed at least in part from alternating flexible chain segments and rigid connector segments with fasteners configured to attach to standard bra loops. Bra cups for sectional bras include various arrangements of standard bra loops allowing attachment of one or more bra straps, one or more back bands, a bridge, and alternatively other decorative items. Such bra cups may include standard bra loops along all edges. Coordinating jewelry may be made out of the same or similar types of components.

8 Claims, 37 Drawing Sheets

(56) References Cited

U.S. PATENT DOCUMENTS

| | | | | |
|---|---|---|---|---|
| 2004/0128733 | A1* | 7/2004 | Hendricks | A41D 7/00 2/69 |
| 2009/0075562 | A1* | 3/2009 | Lung | A41C 3/12 450/86 |
| 2012/0135667 | A1* | 5/2012 | Chan | A41C 3/0092 450/86 |

* cited by examiner

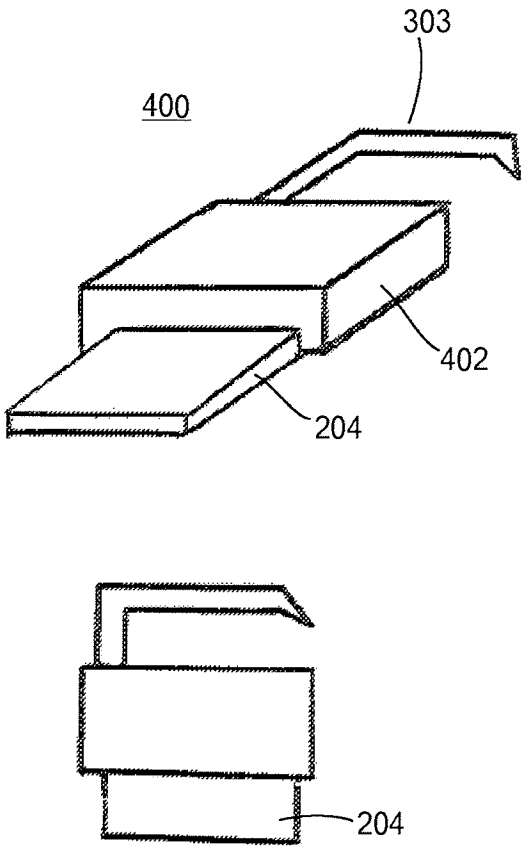
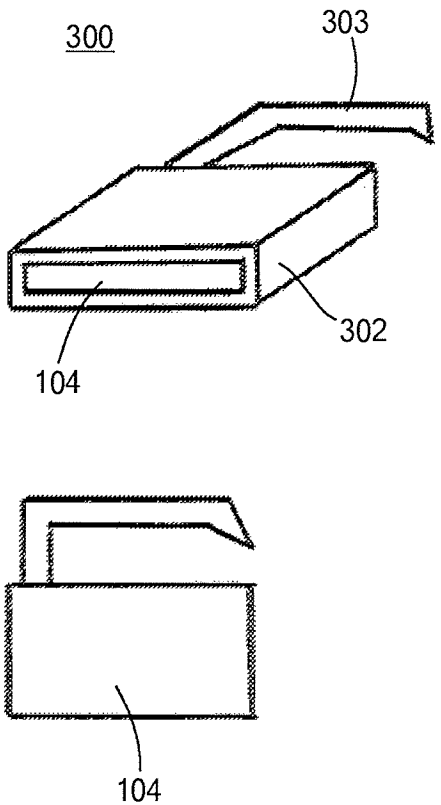
*FIG. 2*

1002
604
602
604
602
608
604
602
604
602
604
602

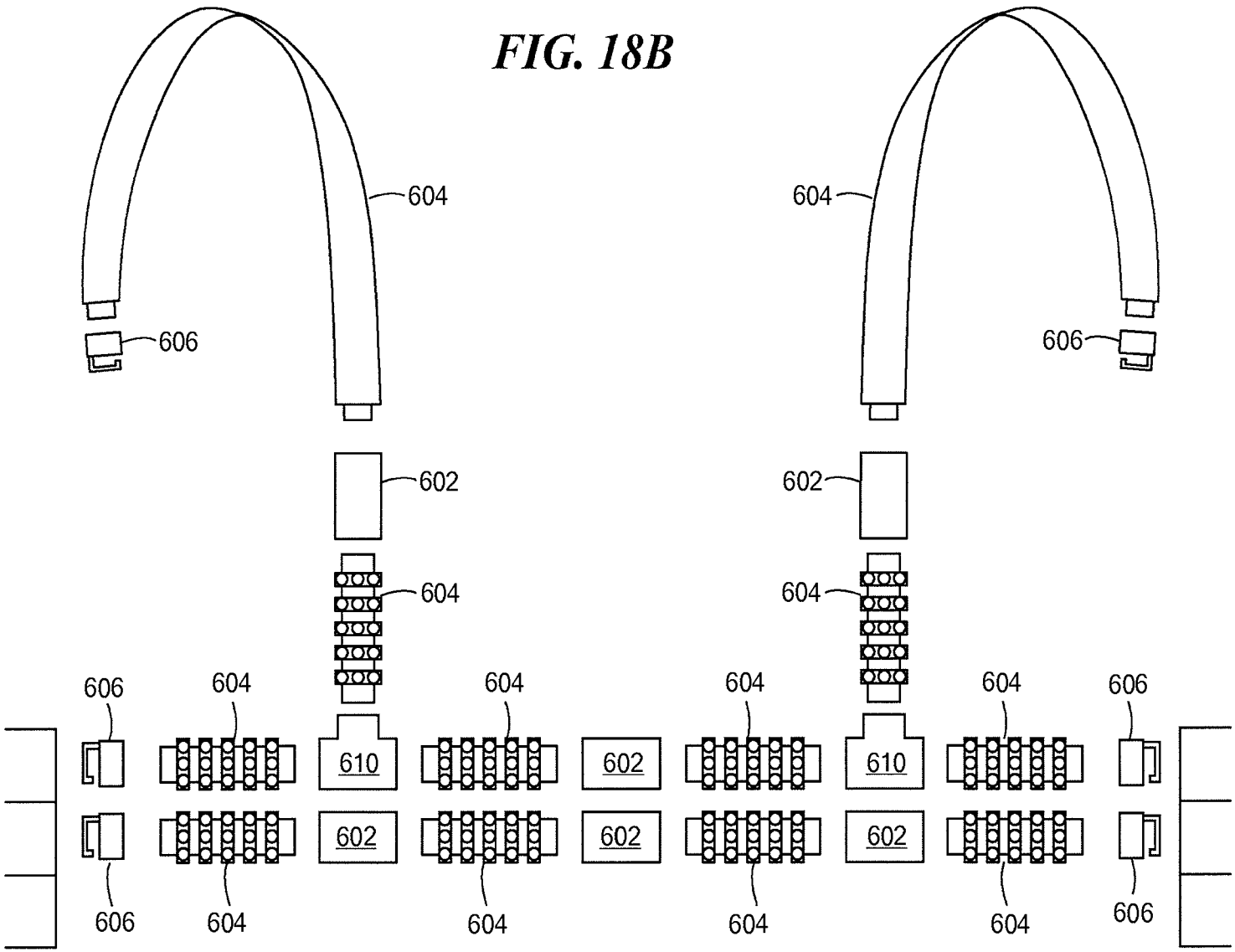
604
606
602
604
610
602
604
606
604
606
604
606

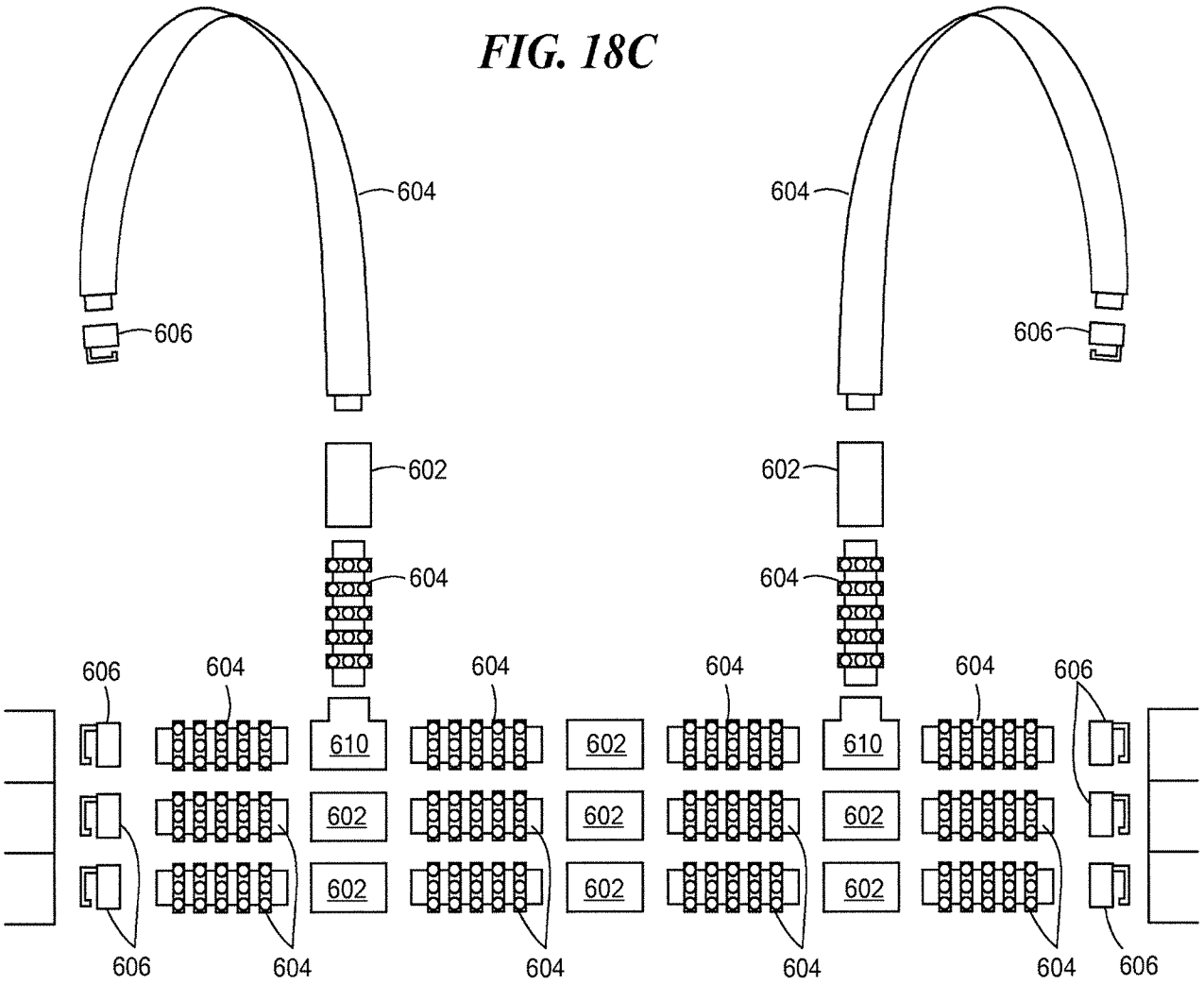
604
606
602
604
610
602
602
604
606
604
606
604
606

MULTI-CONFIGURATION BRA

CROSS-REFERENCE TO RELATED APPLICATION(S)

This patent application is a continuation of, and therefore claims priority from, U.S. patent application Ser. No. 16/392,014 entitled MULTI-CONFIGURATION BRA filed Apr. 23, 2019 (U.S. Pat. No. 11,178,918 issuing Nov. 23, 2021), which is a continuation of, and therefore claims priority from, U.S. patent application Ser. No. 13/867,355 entitled SECTIONAL JEWELRY SYSTEM AND PRODUCT filed Apr. 22, 2013 (U.S. Pat. No. 10,264,826), which is a continuation of, and therefore claims priority from, U.S. patent application Ser. No. 12/749,762 entitled SECTIONAL BRA SYSTEM AND ACCESSORIES filed Mar. 30, 2010 (U.S. Pat. No. 8,425,274), which claims the benefit of U.S. Provisional Patent Application No. 61/165,165 entitled JEWELRY ENHANCEMENTS filed on Mar. 31, 2009. Each of these patent applications is hereby incorporated herein by reference in its entirety.

FIELD OF THE INVENTION

The present invention relates generally to a sectional bra system and accessories.

BACKGROUND OF THE INVENTION

Women come in a variety of sizes, "one size fits all, never fits all," even in bra straps. Most people probably do not realize that regular fabric bra straps, sold with every style of bra, are graded to the size of the bra. Accordingly, regular fabric bra straps are made in different sizes or lengths depending upon the size of the bra.

Over the past five years of fitting women to bras and bra straps, and from her own experience as a larger busted woman, this inventor has come to realize that the size, or length, of a bra strap has little to do with the size of the bra, but instead has more to do with the style of the bra, the stature of the woman, as well as the way the straps are worn (over the shoulder, criss-crossed or halter styles). There are two styles of bras that have detachable bra straps, namely convertible bras and strapless bras. Bra straps are worn shorter with a convertible bra and longer with a strapless bra due to the styles of these bras.

Also, just because a woman wears a large bra does not mean that the bra has to have long or large bra straps. In fact, just the opposite is often true. Large busted women tend to wear their bra straps shorter or tighter, while smaller busted women tend to wear their bra straps longer or looser.

The inventor started designing and manufacturing her own rhinestone bra straps out of a personal need. She has a petite size 4-6 frame but has always been large busted and could not wear even the most common fashions that showed her shoulders, like dresses or tops with spaghetti straps, because she has to wear a bra, with bra straps, for support and her plain bra straps would show. So she needed bra straps that she could attach to her larger size bra that would look pretty enough to "show off" and become a part of her outfit. Now, she can comfortably wear any style outfit she desires with little to no thought by attaching these rhinestone bra straps to her bra. She can wear anything she wants, from halter tops, to strapless, to spaghetti straps, to one shoulder, off-the-shoulder sweaters and any style gown. Because of these rhinestone bra straps, her large size bust no longer limits her to the fashions she, and millions of other women, would like to wear.

Also, the limited styles of rhinestone or beaded bra straps, that are generically manufactured in Asia, or handmade by crafters, would not work for her. They generally are not made strong enough for large busted women, and the rhinestone straps never seem to fit right and will snag clothes while the beaded straps do not support, are commonly made with bicone beads which hurt, continually stretch, and eventually snap. Accordingly, she was forced into manufacturing her own "snag free" rhinestone and beaded bra straps, and, as a result, she has helped thousands of women, from all over the world, with the same problem.

However, her rhinestone and beaded bra straps are not limited to large busted women. She has also helped small busted women because they also have to wear a bra, but for a different reason; they need to add contour and shape. So, small busted women also need bra straps that attach to their bra and are pretty enough to "show off." The inventor's bra straps have changed the way women wear clothes, allowing women of all shapes and sizes to comfortably wear any fashions that show their shoulders while adding glamour and sophisticated style to their outfit.

The inventor of this patent application runs a company called Show Off Straps, Inc. ("SOS"), which specializes in bra straps that look like jewelry. These bra straps hook, or attach, into any strapless or convertible bra and replace ordinary fabric bra straps. SOS's bra straps have helped thousands of women, of all sizes from petite to plus sizes, wear the fashions they desire and are in demand worldwide.

Presently, SOS designs, manufactures and sells "snag free" rhinestone bra straps. The straps are provided in fixed-length sizes from 13 inches, up to and over 19 inches (worn traditionally over each shoulder and as a halter) and 19.5 inches, up to and over 31 inches (worn criss-crossed), all in half-inch increments. Like shoes and rings, a half an inch can make a difference as to whether a bra strap fits comfortably, is too tight, or is too loose.

There are many factors involved with selecting bra straps, including the stature of the wearer, the style of the bra which the strap will be worn, the way in which the strap will be worn (e.g., over the shoulder, across the back of the neck halter-style, etc.) and the garment with which the bra will be worn (e.g., a special garment like a wedding gown). Sometimes a person will choose to have straps attach to a particular outfit, like a strapless gown, instead of a bra, and that could change the length requirement as well. Thus, unlike a shoe or a ring that has a fixed size and a woman knows her size, a woman does not have a fixed strap size; it varies due to the above reasons.

One issue with fixed-length bra straps is that each style needs to be manufactured and stocked in all sizes. For example, if each of 10 styles is manufactured in 27 lengths, then there are 270 individual products being manufactured. Among other things, such a multitude of products increases manufacturing costs (e.g., manufacturers often impose minimum order quantities for each size or charge extra for small quantities) and makes it more difficult to stock all sizes.

Another issue with fixed-length bra straps is that they need to be fitted individually for a particular bra or outfit. In many cases, a person performs a self-measurement, orders or purchases the straps, finds that they are not the correct size, and returns/exchanges them. This is time-consuming and frustrating for the consumer and expensive for the distributor in terms of both handling returns and lost sales.

SOS also designs, manufactures and sells an entire line of coordinating jewelry that matches the bra straps, including bracelets, anklets, necklaces, belts and earrings. This is coordinated jewelry that can be mixed and matched, thus allowing the person to add by the piece. For example, they can buy rhinestones bra straps one month and six months, or a year or more down the road, add, or buy, the matching bracelet or earrings, etc.

SOS currently designs a clip that clips over the bridge or center portion of a bra, but has discontinued it because it is problematic as the size of every bridge on every type of bra is different. Every woman wants to buy the clip but each clip would have to be custom ordered to fit the bridge of their bra, which is not practicable.

SOS has the same problem with her jewelry as she does with the bra straps, "sizing". Jewelry also has to be made in multiple sizes. For example, women commonly complain that they cannot wear bracelets because their wrist is too small or too large, a woman who has a small wrist cannot wear the same size bracelet as a woman that has a larger wrist, and the same is true for belts (hips), anklets and necklaces—many different sizes for many different size women.

Bra straps are currently manufactured in 27 different sizes, necklaces in seven or more sizes; bracelets and anklets in at least ten sizes, and chain belts in four or more sizes. In addition to all these sizes, SOS also takes orders for custom sizes. Generally speaking, no size is more popular than another. As mentioned above, such fixed-length jewelry makes it difficult to manufacture and stock product.

Presently, this jewelry is made with rhinestone cup chain specially adapted to not snag clothing, which is an important feature considering that the rhinestone jewelry sold on the retail market is notorious and well-known for snagging and ruining clothes. When this happens to a good outfit, it can be devastating. Thus, the non-snag feature puts this rhinestone jewelry and bra straps in high demand.

SOS's coordinated earrings are made with 14K gold posts, particularly for women who are sensitive to posts made of other metals. Thus, the entire jewelry line is designed with the purpose of solving common fashion problems that are frustrating to the inventor and other women, in contrast to much of the fashion jewelry on the retail market that is mass produced in limited generic sizes, giving little consideration to the needs and wants of the consumer.

Another problem that this inventor incurs are women continually asking for bras that can be worn with fashions that have plunging necklines and low backs. The few bras on the market, that are designed to wear with these types of fashions, are limited and not made to be worn by larger busted women. They usually have clear plastic straps that tend to stick to the skin and turn yellow or a band that wraps around the waist or hips, and there is even one having straps that wrap over the shoulders and around the underarm, which can be very uncomfortable, and of course there are stick on bras.

The following is a brief and admittedly incomplete overview of some prior art relating to jewelry and bras.

Adjustable Length Chain Bra Straps

The bra strap industry appears to still be in its infancy, they are not widely sold in department stores, and most women are not aware that they exist. A common design is a chain bra strap with an extender chain on it, often made overseas from low-quality materials. The concept of this design is that one can lengthen or shorten it with the extender chain, the same way a necklace might have an extender chain. The problem is that even though bra straps look like jewelry, they are not worn like a necklace. Bra straps have to fit perfectly in order to be comfortable while enduring pressure and tension from movement and weight from larger bust sizes. A necklace does not have to fit perfectly and does not have to bear substantial stresses from movement and weight and therefore does not have to be as strong or fit as comfortably as a bra strap. These adjustable bra straps generally have about 14 inches of decorative or rhinestone chain and about four inches of extender chain. If a person requires a bra strap smaller than 14 inches, these will not fit her. If a person wears a bra strap longer than 14 inches, then extender chain will show on the wearer's back, which is not pretty. Also, they will only extend so long; if a person requires a longer bra strap or wants to wear them crisscrossed, they will not fit. They also have a weak point where the decorative chain is attached to the extender chain, which can break easily, and these chain bra straps are generally made of cheap rhinestone chain, which can snag fabric and ruin clothing. They also never seem to fit comfortably, especially for larger busted women. For these reasons, the adjustable length chain bra straps are not desirable for marketing.

Another design of bra straps that is not widely sold in the stores are bra straps made up of beads that are strung on elastic cord or monofilament mainly manufactured in Asia or hand made by crafters. They are made one size fits all because they stretch. These too are problematic inasmuch as monofilament stretches indefinitely while you are wearing it which separates the beads so you can see the cord until it eventually becomes too long or snaps and the beads fly everywhere. Elastic cord, monofilament and any other type of stretchable cord will not give a woman the support she needs, especially larger busted women and are made more for aesthetic reasons. But even still, these bra straps will not work for most women as "one size fits all, never fits all," even if it stretches.

Bra straps that stretch or extend by extender chain are very limited in their use and will not adequately fit many wearers.

Sectional Jewelry

U.S. Pat. No. 7,406,840 (Brancato) is directed to a length adjustable, multi-function chain composite for use in the apparel, jewelry, and accessory industries. The length adjustable, multi-function chain composite includes at least two chain segments that are separate and independent of each other, and apparatus that is operatively connected to the chain segments and replaceably attaches the chain segments end-to-end collinearly so as to allow the length adjustable, multi-function chain composite to be reconfigurable for being multi-functional.

U.S. Pat. Nos. 5,410,784 and 5,689,867 (Katz) are directed to interchangeable clasps of a type having one or more cylindrical sleeves that receive a rigid rod at the end of a necklace or bracelet. Such clasps can be used to join the two ends of a necklace or bracelet or to join two or more necklaces or bracelets together, e.g., for adjusting the length of the necklace or bracelet.

U.S. Pat. No. 6,799,436 (Minassian) is directed to linkable jewelry device having a male clasp section and a female clasp section at opposite ends of the device. The female clasp section is adjustably retainable by the male clasp section. A plurality of longitudinal inflexible sections are interleaved with and hingedly attached to a plurality of connectors. When the female clasp section is retained by the male clasp section, the device forms an adjustable ring for wearing on a finger. The male clasp section has a number of notches into which a crossbar of the female clasp section may be selectively retained. The ring may be adjusted in diameter depending upon which notch retains the crossbar. Two or more devices may be linked together to form an adjustable-length bracelet or necklace.

Decorative Undergarments

US 2005/0155138 (Zic-Hock) is directed to a device and methods for converting and decorating clothing are disclosed. The device includes a center connection part, and a plurality of extensions, each with one end connected to the center connection part and with another end connected to an attachment structure. The method includes attaching one or more first extensions of the device to one or more first locations of a clothing and attaching one or more second extensions to one or more second locations of the clothing to convert the clothing from one style to another style, or to decorate the clothing. Also disclosed is a multifunctional jewelry piece which can be used to convert a style of clothing, to provide ornamentation to clothing, and to provide ornamentation to a person's body. (FIG. 15B)

US 2009/0205100 (Flower) is directed to a thong panty or thong bathing suit with detachable interchangeable jewelry constructed of a generally triangular shaped front piece and a jewelry thong formed by three beaded strings each having one end connected to a central member and one free end equipped with a clasp for connecting to three rings at three corners of the front piece.

U.S. Pat. No. 5,816,889 (Fildan) is directed to a brassiere has a pair of fabric brassiere cups each provided with respective underwire cups extending through a fabric channel beneath the respective cup. The two cups are interconnected at the front of the brassiere by a decorative link composed of a molded synthetic resin and having a pair of sewing flanges each stitched through to the fabric of the cup. The underwires terminate at the respective sewing flanges.

Adjustable/Modular Bras

U.S. Pat. No. 7,648,408 (Lung) is directed to a user selectable interchangeable bra system that enables users to customize the selection, style, construction, and usage of a bra both through component purchase and interchangeable fit. An infinite number of different size, color and fits are possible, as well as underwire interchangeableness. The center connector can be selected to provide for user selectable cup separation.

U.S. Pat. No. 2,954,031 (Froelhich—cited in Lung) is directed to a bra having separated bra cups that are fastened using a bridging member.

U.S. Pat. No. 6,994,606 (Li—cited in Lung) discloses a bra having a front fastener.

U.S. Pat. No. 6,733,362 (Plew) is directed to an improved brassiere of the type having a pair of cups; a pair of torso bands, and shoulder straps. The bra includes a strip of fabric loops extending along, and just below so as to be hidden by, the free upper edges of the body-facing surfaces of the pair of torso bands and the free upper edges of the body-facing surfaces of the pair of cups, the strip of fabric loops being separated between the pair of cups so as to form a space therebetween. The bra also includes a pair of fabric loops overlying aligned with each other, and being disposed in said space between the pair of cups, just below so as to be hidden by, the free upper edges of the body-facing surfaces of the pair of cups. The bra further includes an upper strip of material overlying said strip of fabric loops and said pair of fabric loops for preventing discomfort to a wearer.

U.S. Pat. No. 7,232,359 (Richardson) is directed to an adjustable bra having first and second bra cups; one or more adjustable back bands connected to the respective bra cups; first and second detachable shoulder straps connected at one end to the respective bra cups and connected at the other end to the adjustable back band or bands; a removable or non-removable underwire in each bra cup that is shorter in length than standard underwire; and a plurality of shoulder strap fastener receiving elements incorporated along an entire length of the back band or bands, wherein the shoulder strap fastener receiving elements are adapted to receive and attach the first and second shoulder straps anywhere along the entire length of the back band or bands, including to both single and double layer back bands to enable a wearer to adjust the fit and comfort of the bra to a wearer's breast size and dimension.

U.S. Pat. No. 6,390,884 (Dragojevic) is directed to a breast cleavage enhancement device which is selectably attached to the rim of a brassiere at multiple locations. Depending on the point of attachment to the brassiere, the brassiere cups are rotated in a clockwise or counter clockwise direction to control the position, cleavage, and separation of the breasts. The adjustable clip is attached to the brassiere at various user selectable locations between the brassiere cups. Placement of the adjustable clip above or below the center point applies rotational pressure to the brassiere cups, which will move the breasts closer together if rotated in one direction, and will move the breasts apart if rotated in the other direction. The adjustable clip can be implemented by a clip that attaches to a conventional brassiere, or by integral hook and loop strips, buttons, string ties, or other suitable devices. Alternative embodiments implement the breast rotation feature on the upper portion of a two-piece bathing suit, and use ornamental clasps to secure the brassiere cups together.

Strapless and Convertible Bras

Strapless bras can be worn with or without straps and are manufactured in many sizes, but women often complain that they just do not stay up, thus making them uncomfortable to wear. They can be so uncomfortable that is common for women to avoid wearing fashions that require a strapless bra. Also, a traditional strapless bra is generally designed with a permanent affixed bridge and back band that has to be covered by the garment.

Convertible bras generally cannot be worn strapless, they have to be worn with straps, however, the straps can detach in order to change the straps, which is why it is called a "convertible" bra. This style bra is also manufactured in a variety of sizes, however, like the strapless bra, a permanently affixed bridge and back band of a traditional convertible bra also has to be covered by the garment.

Convertible bras are generally designed as a plunge bra with cups that are shaped in a triangular design, so this bra cannot be worn with a strapless garment because the pointed part of the triangular cup will show above the garment, thus making it limited as to the styles of fashions that can be worn with this type of bra.

Both strapless and convertible bras are not made to be worn as outerwear, they are underwear and are meant to be covered by a garment.

SUMMARY OF THE INVENTION

As discussed above, SOS currently sells bra straps and matching accessories in fixed-length sizes. While these fixed-length jewelry items have been exceptionally popular and well-received, the inventor has recognized a heretofore unmet need in the marketplace for items that are adjustable for a multitude of sizes, aesthetically beautiful from hook to hook, comfortable, easily manufactured, cost effective for the consumer, and most importantly, technically function properly, and this inventor has succeeded with all of this in her design.

Since this inventor already has a problem with sizing bra straps to bras, she decided to solve the entire problem, for her and millions and other women, so she designed a bra specifically for attaching her rhinestone bra straps, back band, bridge, and other jewelry items. So this inventor saw the need to design a bra that is dedicated, or designed, to work specifically with all of the jewelry that she designed herein, and she has done just that. This inventor has designed a bra that is specially made to work with the rhinestone straps, back band, bridge, and other items that she designed, while maintaining comfort and support, and one that can be worn by both small and large busted women.

A sectional bra system and accessories includes bra and related jewelry components that can be interconnected in various ways. Jewelry items, such as bra straps, back bands, bridge, and other items, may be formed at least in part from alternating flexible chain segments and rigid connector segments with fasteners configured to attach to standard bra loops. Bra cups for sectional bras include various arrangements of standard bra loops allowing attachment of one or more bra straps, one or more back bands, a bridge, and alternatively other decorative items. Such bra cups may include standard bra loops along all edges. Coordinating jewelry may be made out of the same or similar types of components. Among other things, the sectional bra system allows the user to personalize, customize, and size the bra. This bra can be worn as underwear as well as outwear. Worn as outerwear, it becomes an integral part of the design of an outfit while maintaining comfort, support, functionality, modesty, and beauty.

In accordance with one aspect of the invention there is provided a sectional bra system comprising a plurality of flexible chain segments, each chain segment having at each of its ends a first type coupling element; a plurality of two-way rigid connector segments, each two-way connector segment having two opposing second type coupling elements configured for interconnection with a first type coupling element to form a substantially inflexible interconnection that substantially hides the first and second coupling elements; and a plurality of fastener segments, each fastener segment including a fastener configured to attach to a standard bra loop and further including one of (1) a first type coupling element permitting interconnection with a connector segment and (2) a second type coupling element permitting interconnection with a chain segment. Segments are couplable to form at least one of a bra strap and a bra band having a chain portion with a fastener segment coupled to at least one end of the chain portion. The chain portion includes a plurality of chain segments alternatingly interconnected by two-way connector segments.

In various alternative embodiments, the first type coupling elements may be male coupling elements and the second type coupling elements may be female coupling elements, or vice versa. The plurality of flexible chain segments may include at least one long flexible chain segment and a plurality of short flexible chain segments shorter than the long flexible chain segment, and the chain portion may include a long chain segment and a plurality of short chain segments. The fasteners for the fastener segments may be hooks configured for use with standard bra loops, clamps, clips, clasps, or other types of fasteners.

The system may further include a plurality of multi-way rigid connector segments, each multi-way connector segment having three or more coupling elements, wherein segments are couplable to form an integrated arrangement including at least one bra strap and at least one back band.

The system may further include a pair of bra cups, each bra cup including at least one standard bra loop along a top edge of the cup for attaching at least one bra strap to the cup, a plurality of standard bra loops along a lateral edge of the cup for attaching at least one back band to the cup, and at least one standard bra loop along an inner edge of the cup for attaching a bridge to the cup. Such a system may further include a bridge, separate from the bra cups, having hooks for coupling with the bridge loops for interconnecting the bra cups. The bridge may be formed from segments of the type described above. The bridge may include one or more standard bra loops, e.g., to allow bra straps to be attached to the bridge as opposed to the bra cups. Additionally or alternatively, the bridge may include one or more coupling elements of either the first type allowing interconnection with a connector segment or the second type allowing interconnection with a chain segment, e.g., such that the bridge can be made integral with the bra straps or other jewelry items.

In accordance with another aspect of the invention there is provided a sectional bra comprising a pair of bra cups, each bra cup including at least one standard bra loop along a top edge of the cup for attaching at least one bra strap to the cup, a plurality of standard bra loops along a lateral edge of the cup for attaching at least one back band to the cup, and at least one standard bra loop along an inner edge of the cup for attaching a bridge to the cup; at least one back band that attaches to one or more of the plurality of standard bra loops along the lateral edge of each cup; and a bridge that attaches to at least one standard bra loop along the inner edge of each cup.

In various alternative embodiments, each bra cup may include a cup section and a lateral wing section, and the plurality of standard bra loops along the lateral edge of the cup may be along at least a lateral edge of the wing section and/or along an edge of the cup section adjacent to the lateral wing section. Each bra cup may include a plurality of standard bra loops along a bottom edge of the cup. The back band may include a plurality of standard bra loops along at least one of a top edge of the band, a bottom edge of the band, and center portion of the band. The bridge may include one or more standard bra loops.

In accordance with another aspect of the invention there is provided a bra cup for a sectional bra. The bra cup includes a cup; at least one standard bra loop along a top edge of the cup for attaching at least one bra strap to the cup; a plurality of standard bra loops along a lateral edge of the cup for attaching at least one back band to the cup; and at least one standard bra loop along an inner edge of the cup for attaching a bridge to the cup.

In various alternative embodiments, the bra cup may include a cup section and a lateral wing section, and the plurality of standard bra loops along the lateral edge of the cup may be along at least a lateral edge of the wing section and/or along an edge of the cup section adjacent to the lateral wing section. The bra cup may include a plurality of standard bra loops along a bottom edge of the cup.

In contrast to some of the prior art references discussed in the background above, the sectional jewelry items disclosed herein nominally do not link chain segments end-to-end but instead use a rigid connector segment between chain segments and have junctions that are substantially inflexible with coupling elements that are hidden. Length is adjusted by add/removing/replacing segments as opposed to, for example, using notches to adjust the length. Bra cups for a sectional bra have standard bra loops for attaching one or more bra straps, one or more back bands, and a bridge such that an integrated system of sectional jewelry items may be used with the bra.

BRIEF DESCRIPTION OF THE DRAWINGS

The foregoing and advantages of the invention will be appreciated more fully from the following further description thereof with reference to the accompanying drawings wherein:

FIG. 2 schematically shows two types of hook-type fastener segments (e.g., for attaching to loops provided on a bra or other garment), in accordance with an exemplary embodiment of the present invention;

FIGS. 18A-18C show configurations including a back band with integral shoulder straps using "T" connector segments having all female coupling elements;

It should be noted that the foregoing figures and the elements depicted therein are not necessarily drawn to consistent scale or to any scale. Unless the context otherwise suggests, like elements are indicated by like numerals.

DETAILED DESCRIPTION OF SPECIFIC EMBODIMENTS

Figure 1:
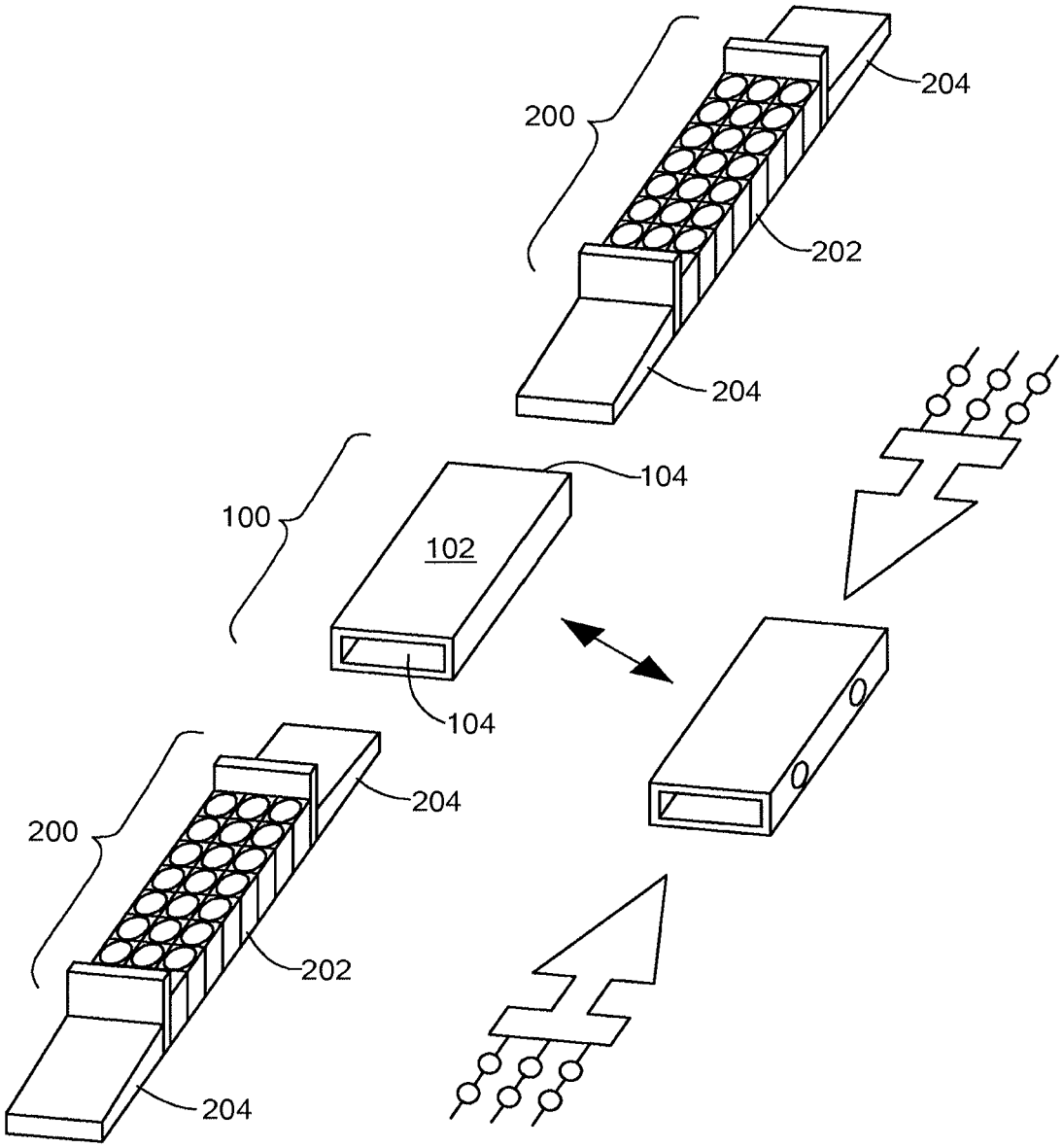
FIG. 1 schematically shows an exploded view of a portion of a jewelry item including a rigid two-way female-female connector segment between two flexible male-male chain segments, in accordance with an exemplary embodiment of the present invention.

Definitions. As used in this description and the accompanying claims, the following terms shall have the meanings indicated, unless the context otherwise requires:

- A "chain segment" for a sectional jewelry item is a flexible section composed of flexible chain (e.g., cup chain) having a coupling element at each end for coupling with segments having complementary coupling elements (e.g., chain segments may have male coupling elements for coupling with segments having complementary female coupling elements, or vice versa).
- A "connector segment" for a sectional jewelry item is a rigid segment having two or more coupling elements for coupling with segments having complementary coupling elements (e.g., connector segments may have female coupling elements for coupling with segments having complementary male coupling elements, or vice versa). Connector segments can be provided with different designs such as a butterfly, flower, a dog, ballerina or saying like "dancer" or just a rhinestone pattern, to name but a few.
- A "fastener segment" for a sectional jewelry item is a rigid segment having a coupling element at one for coupling with a chain segment or connector segment and also having a fastener for attaching to a bra or other garment. The fastener may be a hook or other fastener configured to attach to a loop on a bra or other garment. Alternatively, the fastener may be a clamp, clip, clasp, or other fastener configured to attach to a bra or other garment, e.g., that does not have loops.
- A bra typically includes two cups that are interconnected at the front of the wearer by a bridge. A bra typically (but not necessarily) includes a band that extends around the back of the wearer and is typically attached to the lateral edges of the cups. The band may include a clasp to allow for hooking and unhooking of the bra from the back and/or may include a mechanism for adjusting the length of the band (which may also act as the clasp). A bra typically (but not necessarily) includes one or more straps that help to support the bra on the wearer. For example, a bra may include one or more straps that are worn over the shoulder, across the back of the neck, or otherwise. Bra straps may be coupled to the cups, the bridge, and/or the band. A bra may be designed or convertible so as to be wearable in different configurations, for example, strapless, with a single shoulder strap, with two shoulder straps, with a halter strap, with straps that crisscross, etc.
- A "standard bra loop" (sometimes referred to herein as a bra loop or simply a loop) is a loop of thread, fabric, or other material typically used for receiving a hook-type fastener of a removable bra strap.

Sectional Jewelry Items

In certain embodiments of the present invention, sectional jewelry items (e.g., bra straps, bra bands, bra bridges, belts, bracelets, anklets, necklaces, pocketbook handle, etc.) are formed at least in part from flexible chain segments and rigid connector segments coupled together in an alternating pattern (i.e., two chain segments are coupled by a connector segment). The junction between a flexible chain segment and a rigid connector segment is substantially inflexible (e.g., for strength) and substantially hides the coupling elements used to make the interconnection (e.g., for aesthetics).

In exemplary embodiments described below, the segments are coupled using a box-and-tongue type clasp (e.g., one segment includes a tongue-type coupling element that is removably received by a box-type coupling element of another segment), although it should be noted that the present invention is not limited to such a clasp and it will be apparent based on the present that other types of clasps known in the art or otherwise may be used to similarly couple segments in this fashion.

In exemplary embodiments described below, the flexible chain segments may be provided with male coupling elements at each end and the two-way rigid connector segments may be provided with female coupling elements at each end. Multi-way connector segments (i.e., having three or more coupling elements) may include all male coupling elements, all female coupling elements, or a mixture of different types of coupling elements.

Figure 33:
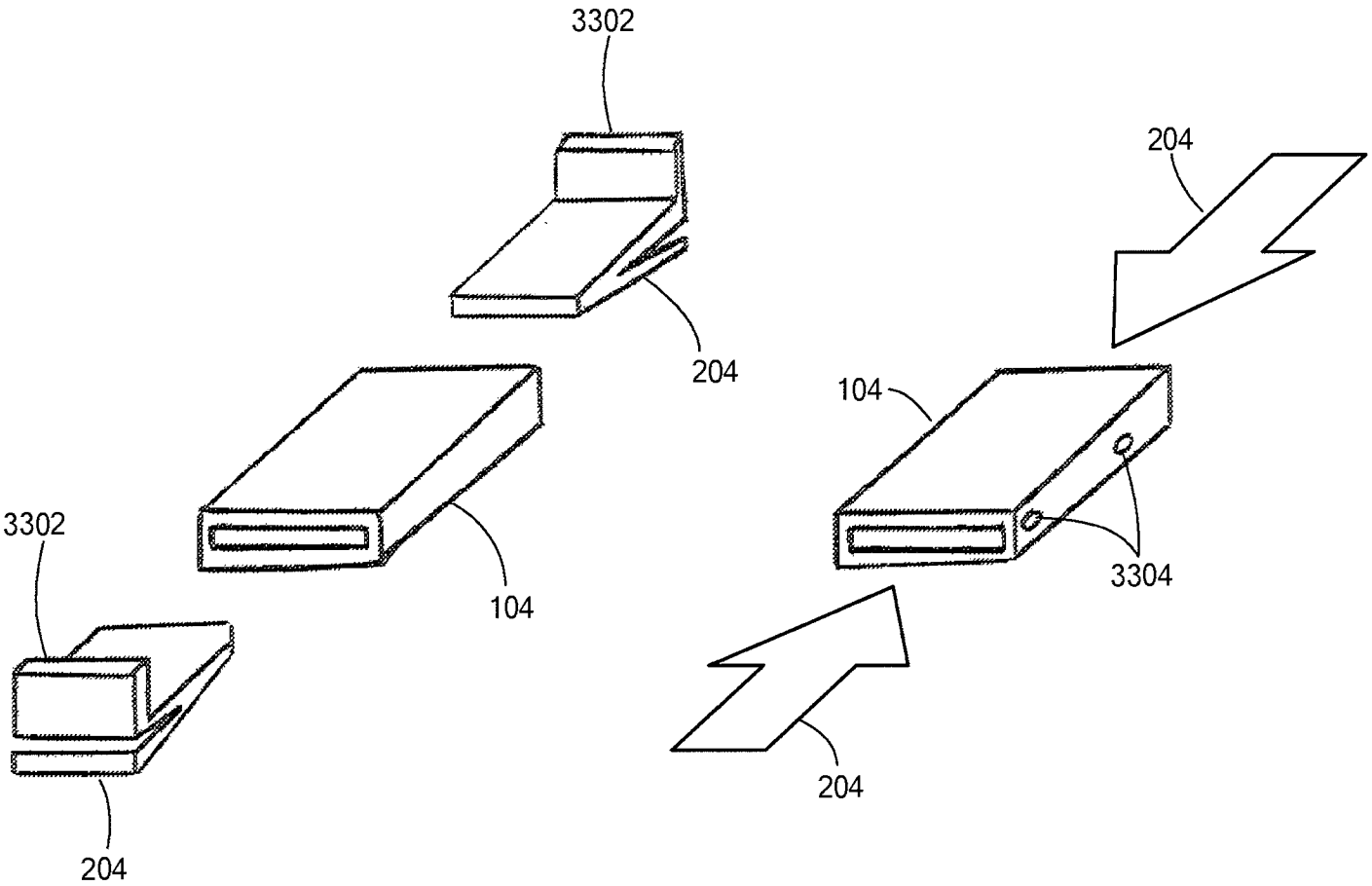
FIG. 33 shows some exemplary releasable coupling configurations.

FIG. 1 schematically shows an exploded view of a portion of a jewelry item including a rigid two-way female-female connector segment 100 between two flexible male-male chain segments 200, in accordance with an exemplary embodiment of the present invention. As shown, the two-way connector segment 100 includes a body 102 having opposing female coupling elements 104. Each chain segment 200 includes a chain 202 with male coupling elements 204 at each end. The chain 202 may be of any suitable type of chain (e.g., cup chain). The coupling elements may use any of a variety of mechanisms to secure and release the coupling elements. For example, as depicted in FIG. 33, the male coupling elements 204 may be spring loaded such that the male coupling element 204 is released by compressing it, e.g., by pressing down on the top release portion 3302 of the male coupling element 204; alternatively, the female coupling element 104 may include an active mechanism to secure and release the male coupling element 204, e.g., with actuators 3304 for the female coupling elements 104 positioned on segment (actuators on the sides are shown, although the actuators could be in other locations such as the top and/or bottom.

FIG. 2 schematically shows two types of hook-type fastener segments (e.g., for attaching to loops provided on a bra or other garment), in accordance with an exemplary embodiment of the present invention. A female hook-type fastener segment 300 includes a body 302 with a hook 303 at one end and a female coupling element 104 at the other end. A male hook-type fastener segment 400 includes a body 402 with a hook 303 and a male coupling element 204. With reference back to FIG. 1, a female hook-type fastener segment 300 may be coupled with the male coupling element of a chain segment 200, and a male hook-type fastener segment 400 may be coupled with the female coupling element of a connector segment 100. It should also be noted that a female hook-type fastener segment 300 may be coupled with a male hook-type fastener segment 400, e.g., to form a bridge segment with hooks at both ends, as discussed more fully below. It should be noted that similar fastener segments may include different types of fasteners, e.g., a clamp, clip, clasp, or other fastener.

Figure 3:
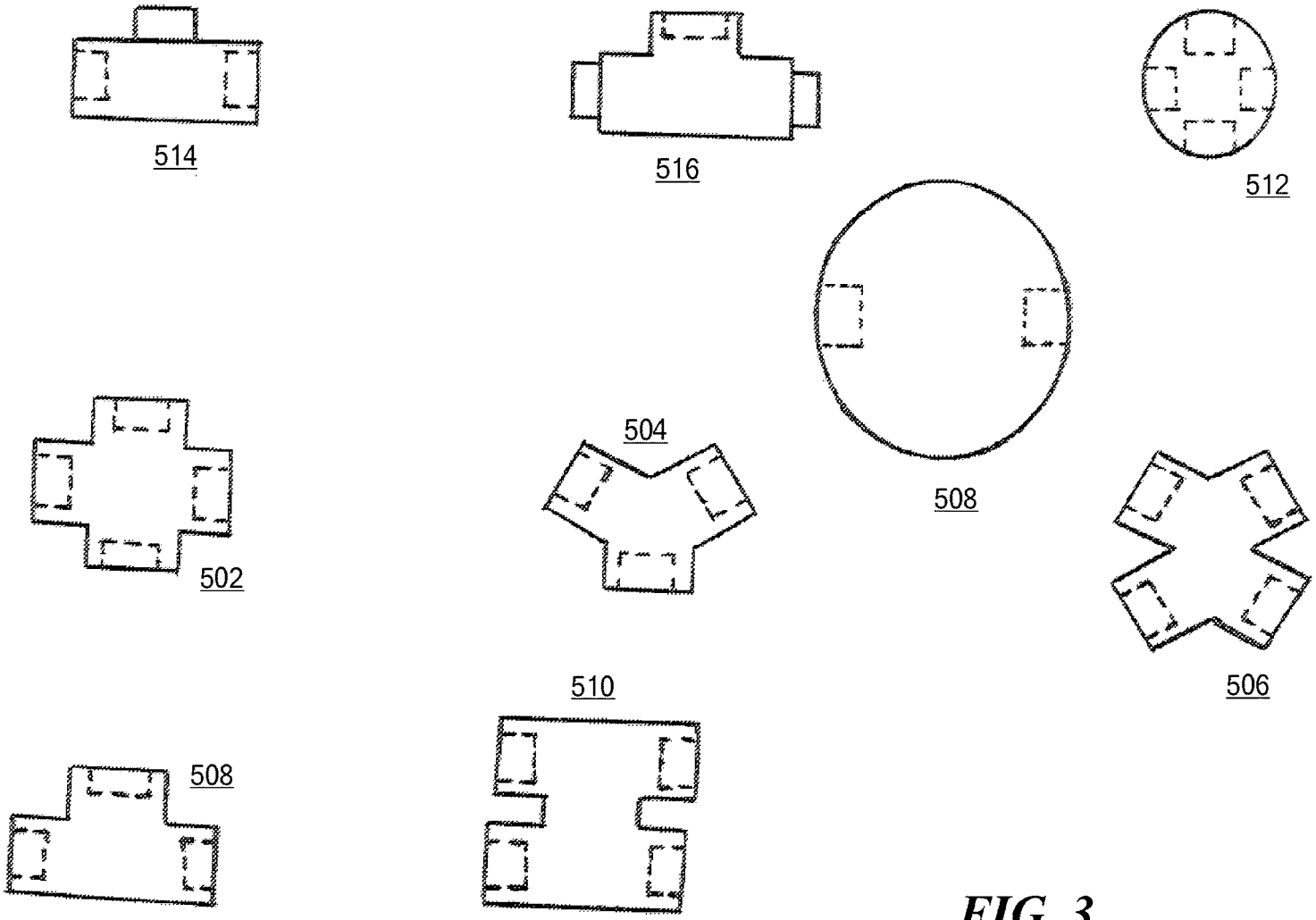
FIG. 3 schematically shows various types of multi-way connector segments (i.e., having three or more coupling elements), in accordance with exemplary embodiments of the present invention.

FIG. 3 schematically shows various types of multi-way connector segments (i.e., having three or more coupling elements) including connector segments in cross 502, "Y" 504, "X" 506, "T" 508, "I" 510, and circle 512 arrangements, in accordance with exemplary embodiments of the present invention. As discussed above, multi-way connector segments may include all male coupling elements, all female coupling elements, or a mixture of different types of coupling elements (e.g., T connectors 514 and 516 include a mixture of male and female coupling elements). Of course, other multi-way connector segment arrangements are possible. Also, as shown in FIG. 3, a two-way connector segment 518 may be circular, or, for that matter, may be any other shape.

It should be noted that sectional jewelry items can be formed from segments having different characteristics, such as different lengths, sizes, colors, designs, materials, ornaments, jewels, etc. For example, a particular jewelry item may have chain segments of one color interconnected by connector segments of a different color. Some connector segments in a jewelry item may have ornaments (e.g., beads, jewels, flowers, etc.) while others do not, and different ornamented connector segments may have different ornaments. Different fastener segments in a jewelry item may have different types of fasteners (e.g., a hook at one end of a strap and a clip at the other end of the strap). Segments can be combined, recombined, replaced/substituted to form a variety of jewelry item configurations.

It also should be noted that the sectional components described above are preferably made using "snag free" chain and components.

Sectional Bra Straps/Bands

In various embodiments of the present invention, sectional jewelry items may include sectional straps and bands formed at least in part from alternating flexible chain segments and rigid connector segments with a fastener segment at each end of the strap/band, e.g., for attachment to a bra or other garment. By adding or removing segments, the straps/bands can be sized as needed or desired (e.g., to be worn traditionally, one over each shoulder, or longer for criss-crossed or halter) and/or reconfigured (e.g., to match an outfit or just to suit the wearer's individual style). Also, unlike certain prior art bra straps, there is no unsightly extender chain.

As discussed more fully below, bras and other garments may be provided with various arrangements of loops to allow for attaching straps and/or bands to the garment. For example, bras may be provided with loops at the upper edges of the bra cups and/or at the bridge for attachment of one or more bra straps, may be provided with loops at the lateral sides of the bra cups (e.g., along the lateral edges of the cups and/or along the lateral edges of wing portions) for attachment of one or more back bands, may be provided with loops at the inner edges of the bra cups for attachment of a removable bridge, may be provided with loops along the bottom edges of the bra cups, and/or may be provided with loops along the back band. In certain embodiments, loops may be provided substantially along all edges of the bra cups and back band.

In certain embodiments of the present invention, a system (components of which may be sold individually and/or as a kit) includes various types of chain segments, connector segments, and fastener segments to allow users to configure sectional bra straps and/or bands that may be attachable exclusively to sectional bras of the types discussed below.

Figure 4:
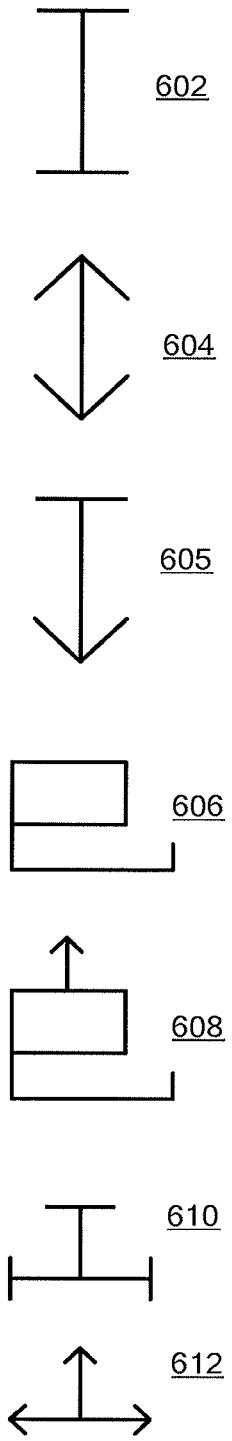
FIG. 4 schematically shows some components that may be included in a first exemplary system.

FIG. 4 schematically shows some components that may be included in a first exemplary system. Here, the components include two-way female-female connector segments 602, male-male chain segments 604, male and female fastener segments 606 and 608 (e.g., with end terminal that slides through a loop on the bra), and optionally three-way "T" connector segments (e.g., all-female "T" segments 610 and/or all-male "T" segments 612, e.g., to connect bra straps to bra band). The system optionally may include male-female segments 605 (which may include chain segments and/or connector segments), for example, in short lengths (e.g., 0.5 inch) used for making fine length adjustments. Any or all of these components may be provided in multiple sizes/lengths, e.g., 1-inch and 1.5-inch connector segments, 1-inch and/or 2-inch chain segments, 0.5-inch fastener segments, and 1-inch "T" segments.

Figure 5:
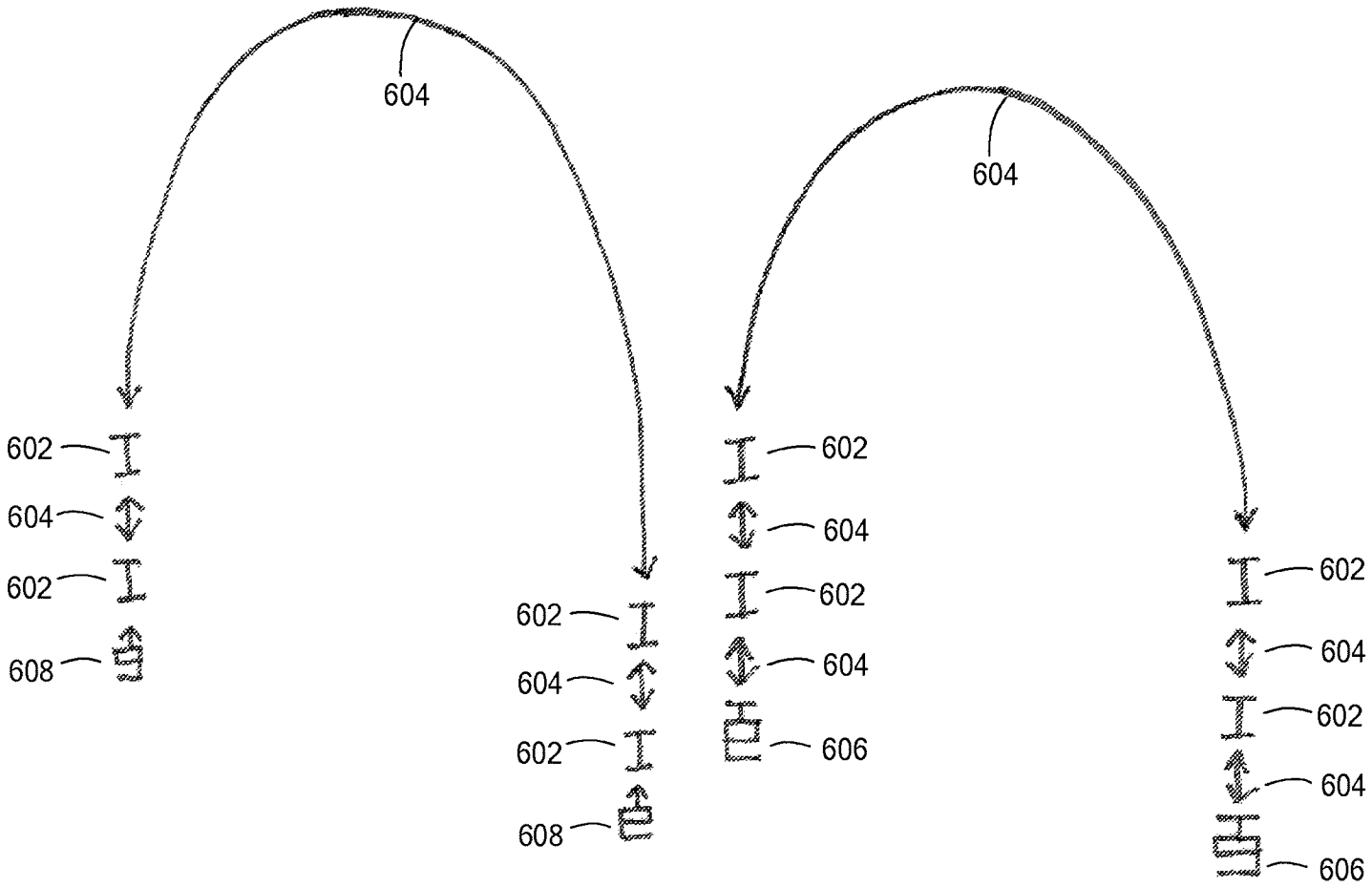
FIG. 5 shows two exemplary straps/bands formed from the components shown in FIG. 4.

FIG. 5 shows two exemplary straps/bands formed from the components shown in FIG. 4. In the strap shown on the left side of the drawing, the chain portion of the strap terminates with connector segments 602 (i.e., terminating with a female coupling element), so male fastener segments 608 are used. In the strap shown in the right side of the drawing, the chain portion of the strap terminates with chain segments 604 (i.e., terminating with a male coupling element), so female fastener segments 606 are used.

Figure 6:
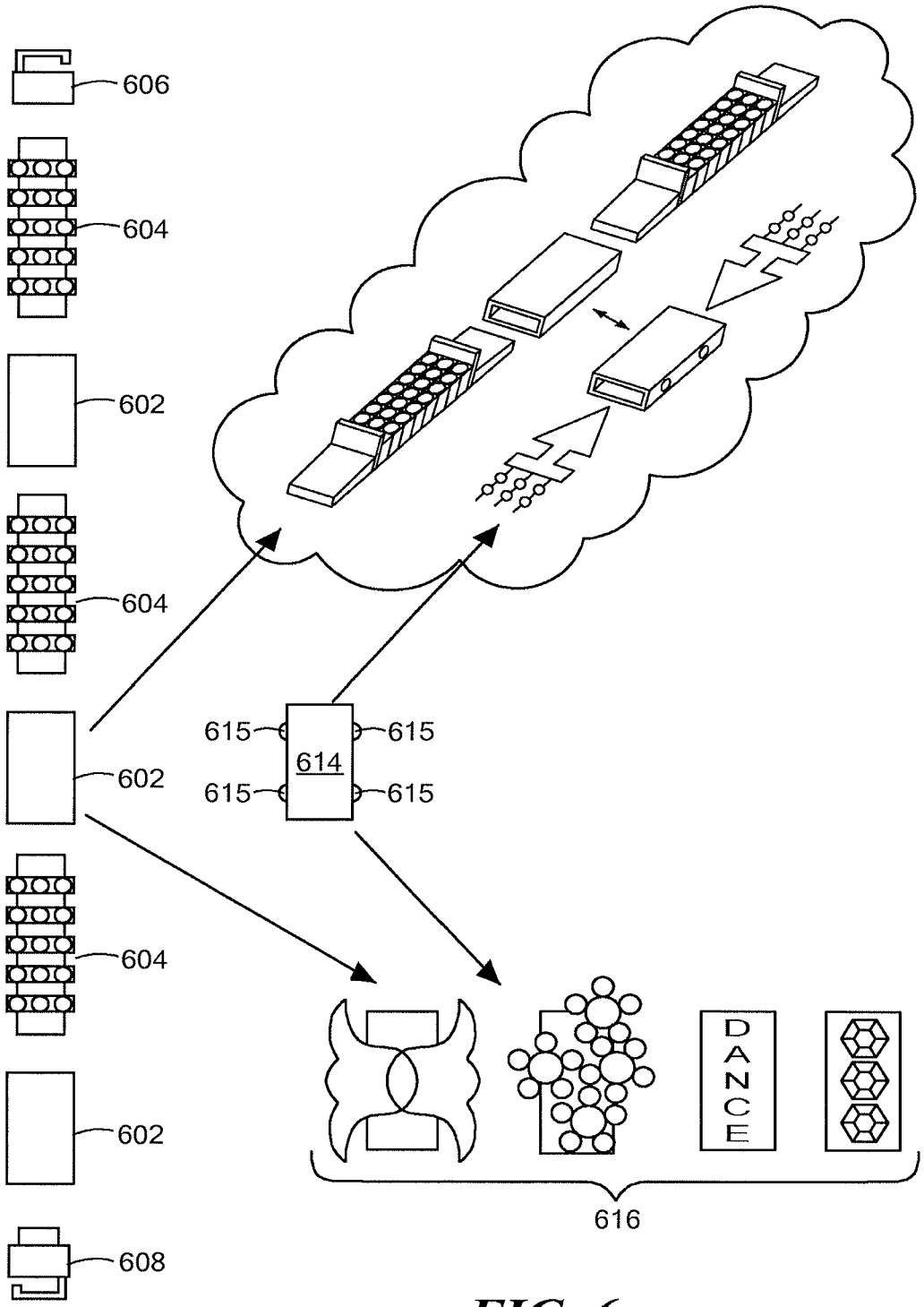
FIG. 6 shows an exemplary strap/band terminating with different fastener segments, shows a representation of a connector segment having box-type coupling elements with spring-release mechanisms for releasably securing male coupling elements, and shows representations of various connector segment designs.

In practice, the chain portion of the strap may terminate with a male coupling element at one end and female coupling element at the other end, such that female and male fastener segments would be used respectively. FIG. 6 shows an exemplary strap/band terminating with different fastener segments. FIG. 6 also shows a representation of a female-female connector segment (614) having box-type coupling elements with spring-release mechanisms 615 for releasably securing male coupling elements. FIG. 6 also shows representations of various connector segment designs (616) including, from left to right, a butterfly, flowers, wording, and rhinestones.

Figure 7:
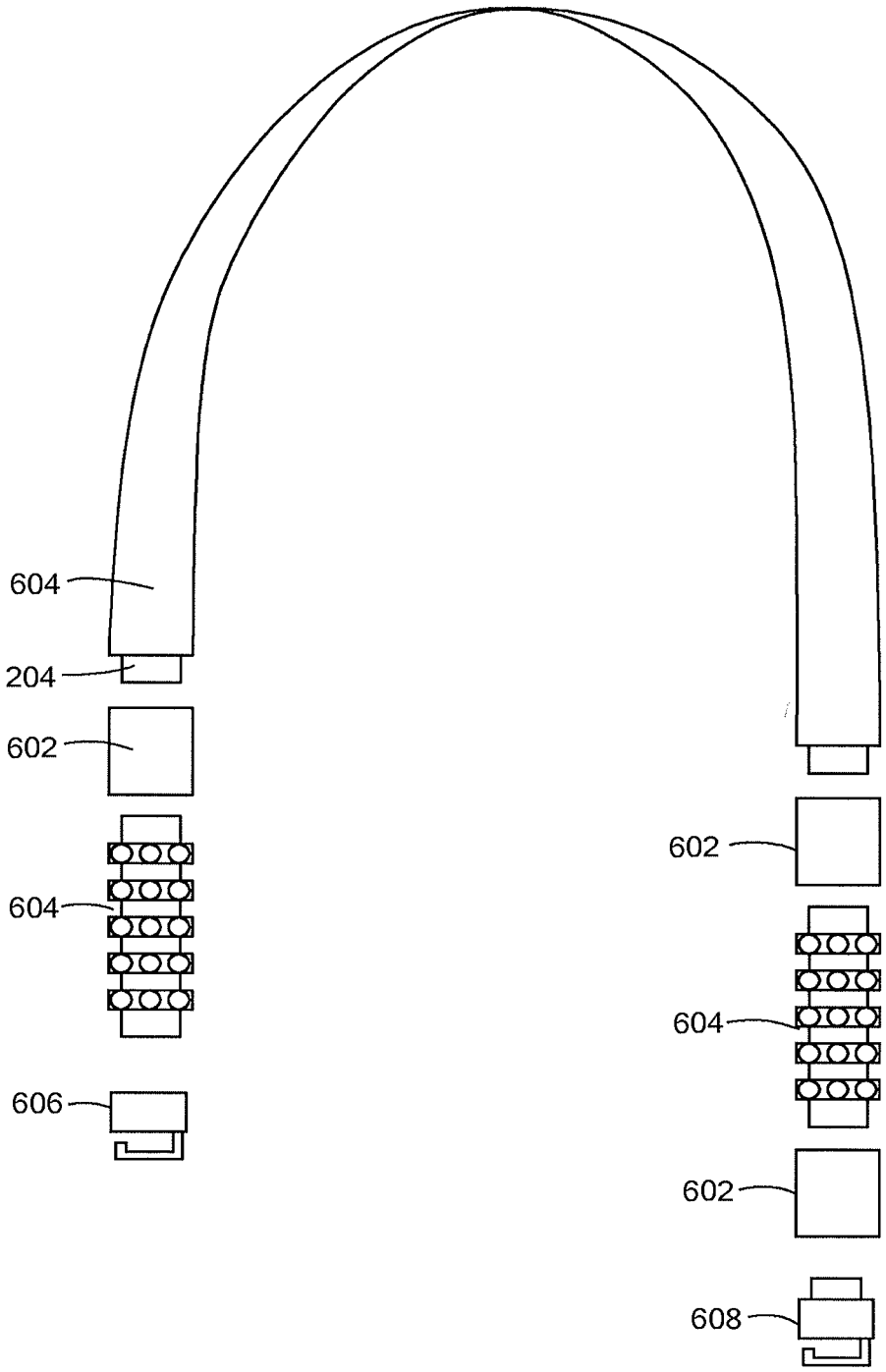
FIG. 7 shows an exploded view of a strap/band of the type shown in FIG. 6.

FIG. 7 shows an exploded view of a strap/band of the type shown in FIG. 6, with the various elements identified.

Figure 8:
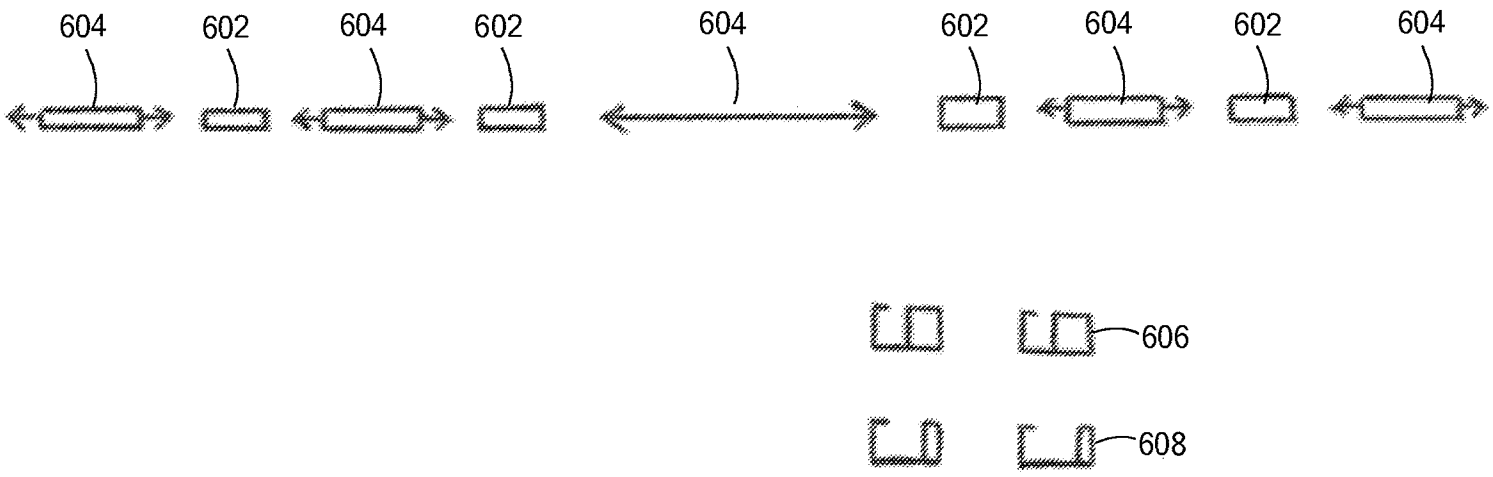
FIG. 8 shows an exemplary strap/band arrangement including 2-inch and 6-inch male-male chain segments, 1-inch female-female connector segments, and 0.5-inch fastener segments.

FIG. 8 shows an exemplary strap/band arrangement including 2-inch and 6-inch male-male chain segments 604, 1-inch female-female connector segments 602, and 0.5-inch fastener segments 606, 608. Specifically, from left to right, the chain portion of the strap/band arrangement includes a 2-inch male-male chain segment 604, a 1-inch female-to-female connector segment 602, a 2-inch male-male chain segment 604, a 1-inch female-to-female connector segment 602, a 6-inch male-male chain segment 604, a 1-inch female-to-female connector segment 602, a 2-inch male-male chain segment 604, a 1-inch female-to-female connector segment 602, and a 2-inch male-male chain segment 604.

Figure 9:
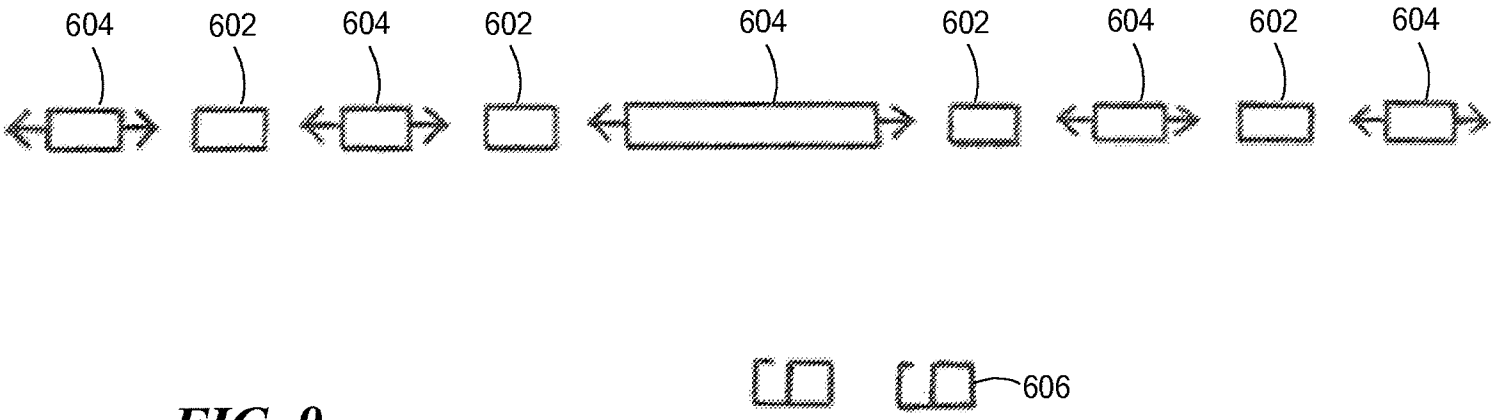
FIG. 9 shows an exemplary strap/band arrangement including 1-inch and 7-inch male-male chain segments, 1-inch female-female connector segments, and 0.5-inch fastener segments.

FIG. 9 shows an exemplary strap/band arrangement including 1-inch and 7-inch male-male chain segments 604, 1-inch female-female connector segments 602, and 0.5-inch fastener segments 606. Specifically, from left to right, the chain portion of the strap/band arrangement includes a 1-inch male-male chain segment 604, a 1-inch female-to-female connector segment 602, a 1-inch male-male chain segment 604, a 1-inch female-to-female connector segment 602, a 7-inch male-male chain segment 604, a 1-inch female-to-female connector segment 602, a 1-inch male-male chain segment 604, a 1-inch female-to-female connector segment 602, and a 1-inch male-male chain segment 604.

In the exemplary embodiments described above, in order to allow for more granular length adjustments, chain segments and/or connector segments may be provided in fractional sizes, e.g., segments may be provided in lengths of 1-inch, 1.25-inch, 1.5-inch, 1.75-inch, etc.

In a sectional bra strap system, it is desirable to limit the number of different types/sizes of segments so that the system components can be manufactured in volume while being usable in a wide variety of arrangements.

In certain embodiments of the present invention, straps/bands can be configured in a wide range of lengths in half-inch increments using a limited number of segment types, specifically 1-inch and 1.5-inch connector segments, 1-inch chain segments, 0.5-inch fastener segments (all of the same orientation), and a single long chain segment. For convenience, examples are now provided for configuring straps/bands of 13 inches and longer using a single long chain segment, no more than three 1.5-inch connector segments, two fastener segments, and a number of 1-inch chain segments and 1-inch connector segments, although it will be apparent that shorter lengths are possible by reducing the length of the long chain segment. Among other things, such systems allow the 1-inch chain segments, the 1-inch connector segments, and the fastener segments to be made in large quantities.

In the following example, the chain portion of the strap/band always ends with a female coupling element at both ends. The following abbreviations are used:

1F=1 inch female-female rigid connector segment
1M—1 inch male-male flexible chain segment
1.5F=1.5 inch female-female rigid connector segment
6M=6 inch male-male flexible chain segment
H=0.5" male hook-type fastener segment Straps/bands of length 13, 13.5, 14, and 14.5 inches can be formed respectively as follows:

H+1F+1M+1F+6M+1F+1M+1F+H
H+1F+1M+1F+6M+1F+1M+1.5F+H
H+1.5F+1M+1F+6M+1F+1M+1.5F+H
H+1F+1M+1.5F+6M+1.5F+1M+1.5F+H

Additional lengths can be produced by adding one or more additional pairs of 1M and 1F segments, e.g., a 15" strap may be formed by adding a 1M and a 1F to the 13" configuration, a 15.5" strap may be formed by adding a 1M and a 1F to the 13.5" configuration, a 16" strap may be formed by adding a 1M and a 1F to the 14" confirmation, a 16.5" strap may be formed by adding a 1M and a 1F to the 14.5" strap, a 17" strap may be formed by adding a 1M and a 1F to the 15" configuration, and so on. The following are exemplary configurations for 15 inches to 18.5 inches in half-inch increments, although it will be apparent how lengths of 19 inches and up may be formed:

H+1F+1M+1F+6M+1F+1M+1F+1M+1F+H
H+1F+1M+1F+6M+1F+1M+1.5F+1M+1F+H
H+1.5F+1M+1F+6M+1F+1M+1.5F+1M+1F+H
H+1.5F+1M+1F+6M+1F+1M+1.5F+1M+1.5F+H
H+1F+1M+1F+1M+1F+6M+1F+1M+1F+1M+1F+H
H+1F+1M+1F+1M+1F+6M+1F+1M+1.5F+1M+1F+H
H+1F+1M+1.5F+1M+1F+6M+1F+1M+1.5F+1M+1F+H
H+1F+1M+1.5F+1M+1F+6M+1F+1M+1.5F+1M+ 1.5F+H

One thing to note is that these strap configurations are not necessarily symmetric, i.e., there may be more segments to one side of the over-the-shoulder chain segment, such as shown in the 15" configuration shown above. The extra segments could be positioned in front or in back of the person wearing it. The 6M chain segment typically would be positioned so as to be worn over the shoulder.

A similar but alternative embodiment may use an 8-inch male-male chain segment (8M) instead of the 6-inch male-male chain segment (6M). The following are exemplary configurations for 13 inches to 18.5 inches in half-inch increments, although it will be apparent how lengths of 19 inches and up may be formed:

H+1F+8M+1F+1M+1F+H
H+1F+8M+1.5F+1M+1F+H
H+1.5F+8M+1.5F+1M+1F+H
H+1.5F+8M+1.5F+1M+1.5F+H
H+1F+1M+1F+8M+1F+1M+1F+H
H+1F+1M+1F+8M+1.5F+1M+1F+H
H+1F+1M+1.5F+8M+1.5F+1M+1F+H
H+1F+1M+1.5F+8M+1.5F+1M+1.5F+H
H+1F+1M+1F+8M+1F+1M+1F+1M+1F+H
H+1F+1M+1F+8M+1.5F+1M+1F+1M+1F+H
H+1F+1M+1.5F+8M+1.5F+1M+1F+1M+1F+H
H+1F+1M+1.5F+8M+1.5F+1M+1.5F+1M+1F+H

In the above embodiments, the fastener segments include male coupling elements and always attach to a female coupling element of a female-female rigid connector element at the end of the chain section of the strap/band.

In various alternative embodiments, the orientation of segments could be reversed (e.g., the chain segments end with female coupling elements and the connector segments end with male coupling elements) such that the sectional chain always ends with a male coupling element and the fastener segments include female coupling elements. The following is an example using a long female-female chain segment (8F), up to three 1.5-inch connector segments (1.5F), two 0.5-inch female fastener segments (H), and a number of 1-inch female-female chain segments (1F) and 1-inch male-male connector segments (1M):

H+1M+8F+1M+1F+1M+H
H+1M+8F+1.5M+1F+1M+H
H+1.5M+8F+1.5M+1F+1M+H
H+1.5M+8F+1.5M+1F+1.5M+H
H+1M+1F+1M+8F+1M+1F+1M+H
H+1M+1F+1M+8F+1.5M+1F+1M+H
H+1M+1F+1.5M+8F+1.5M+1F+1M+H
H+1M+1F+1.5M+8F+1.5M+1F+1.5M+H
H+1M+1F+1M+8F+1M+1F+1M+1F+1M+H
H+1M+1F+1M+8F+1.5M+1F+1M+1F+1M+H
H+1M+1F+1.5M+8F+1.5M+1F+1M+1F+1M+H
H+1M+1F+1.5M+8F+1.5M+1F+1.5M+1F+1M+H

It should be noted that components for one or more straps/bands may be provided as a kit. For example, a kit for a single strap/band might include a long chain segment, three 1.5-inch connector segments, two fastener segments, and some number of 1-inch chain segments and connector segments. It should be noted that the number of 1-inch chain segments and 1-inch connector segments in the kit need not be equal, e.g., in the examples above that use a M-M over-the-shoulder chain segment, there are two more 1-inch F-F connector segments than 1-inch M-M chain segments, and in the above example that uses an F-F over-the-shoulder chain segment, there are two more 1-inch M-M connector segments than 1-inch F-F chain segments. The kit could be a starter kit (e.g., with the components for a 13-inch to 19-in strap/band or a pair of straps/bands), with additional components purchased separately to configure additional lengths and/or designs.

Using multi-way connectors, various configurations of straps and/or bands can be created.

Figure 10:
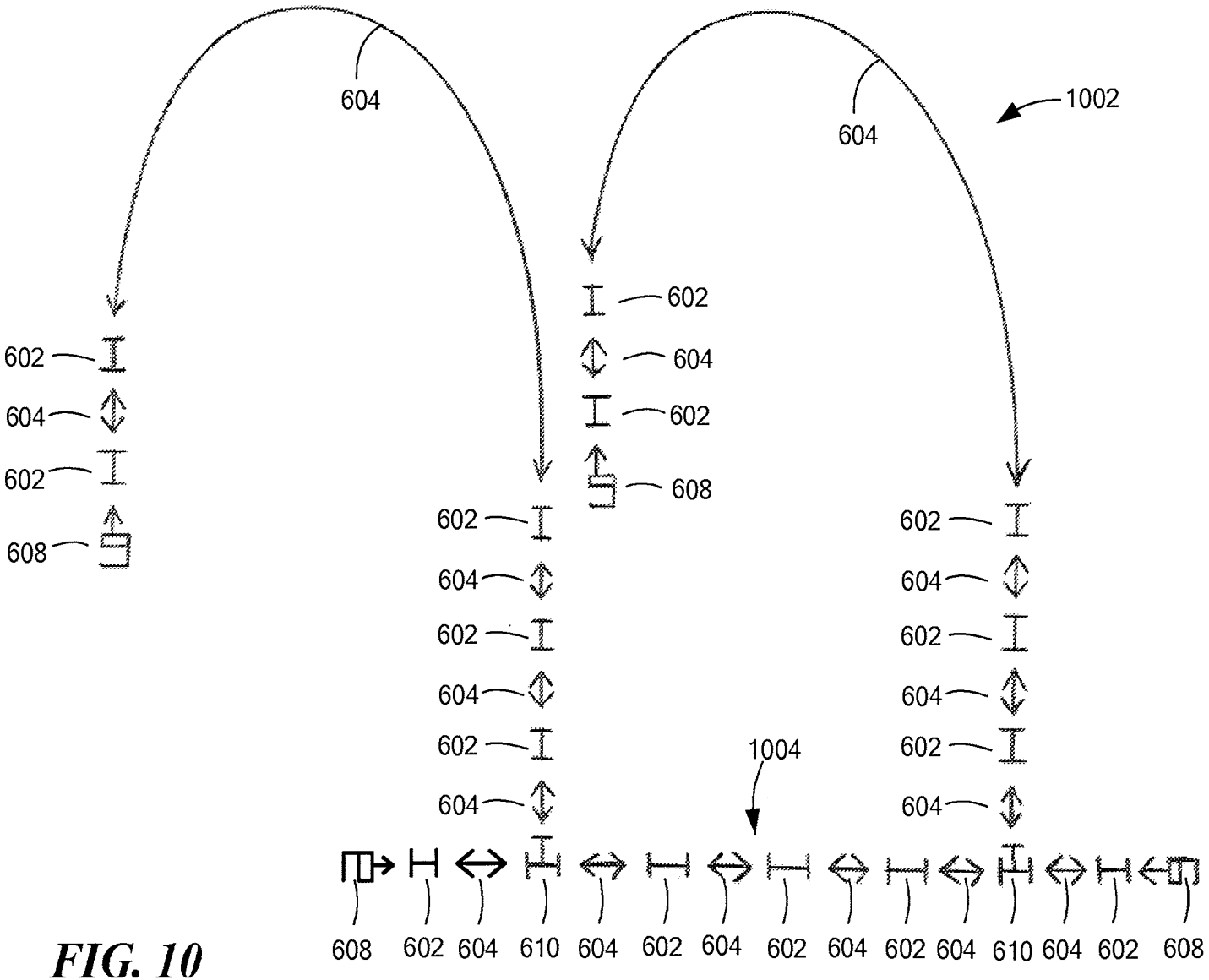
FIG. 10 shows an exemplary configuration including two shoulder straps and a back band created from the types of components shown in FIG. 4.

FIG. 10 shows an exemplary configuration including two shoulder straps 1002 and a back band 1004 created from the types of components shown in FIG. 4. Here, hook-type fastener segments 608 are provided at the front ends of the shoulder straps 1002 for attaching to corresponding loops at the front of the bra and hook-type fastener segments 608 are provided at the ends of the back band 1004 for attaching to corresponding loops at the lateral sides of the bra cups, specifically for use with various bras discussed more fully below. This configuration uses female-female "T" connector segments 610 to connect the bra straps 1002 to the back band 1004, although it should be noted that, in various alternative configurations, male-male "T" connector segments may be used. In this exemplary configuration, each strap 1002 includes, from left to right, a male fastener segment 608, a F-F connector segment 602, a M-M chain segment 604, a F-F connector segment 602, a long M-M chain segment 604, a F-F connector segment 602, a M-M chain segment 604, a F-F connector segment 602, a M-M chain segment 604, a F-F connector segment 602, and a M-M chain segment 604 that connects to a female-to-female "T" connector segment 610. The back band 1004 includes, from left to right, a male fastener segment 608, a F-F connector segment 602, a M-M chain segment 604, a "T" connector segment 610, a M-M chain segment 604, a F-F connector segment 602, a M-M chain segment 604, a F-F connector segment 602, a M-M chain segment 604, a F-F connector segment 602, a M-M chain segment 604, a "T" connector segment 610, a M-M chain segment 604, a F-F connector segment 602, and a male fastener segment 608.

Figure 11:
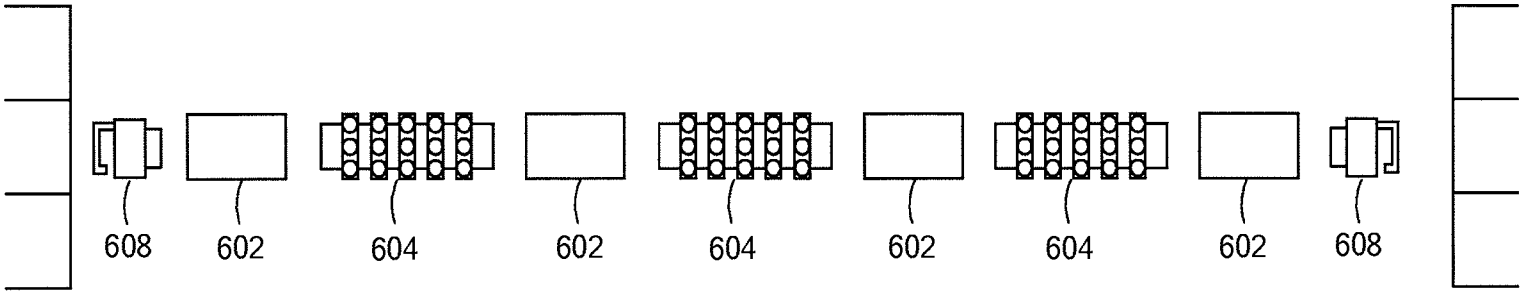
FIG. 11 shows a strap/band configuration, here represented as a back band configuration that attaches to loops at the lateral sides of the bra cups.

FIG. 11 shows a strap/band configuration, here represented as a back band configuration that attaches to loops at the lateral sides of the bra cups. From left to right, the strap/band configuration includes a male fastener segment 608, a F-F connector segment 602, a M-M chain segment 604, a F-F connector segment 602, a M-M chain segment 604, a F-F connector segment 602, a M-M chain segment 604, a F-F connector segment 602, and a male fastener segment 608.

Figure 12:
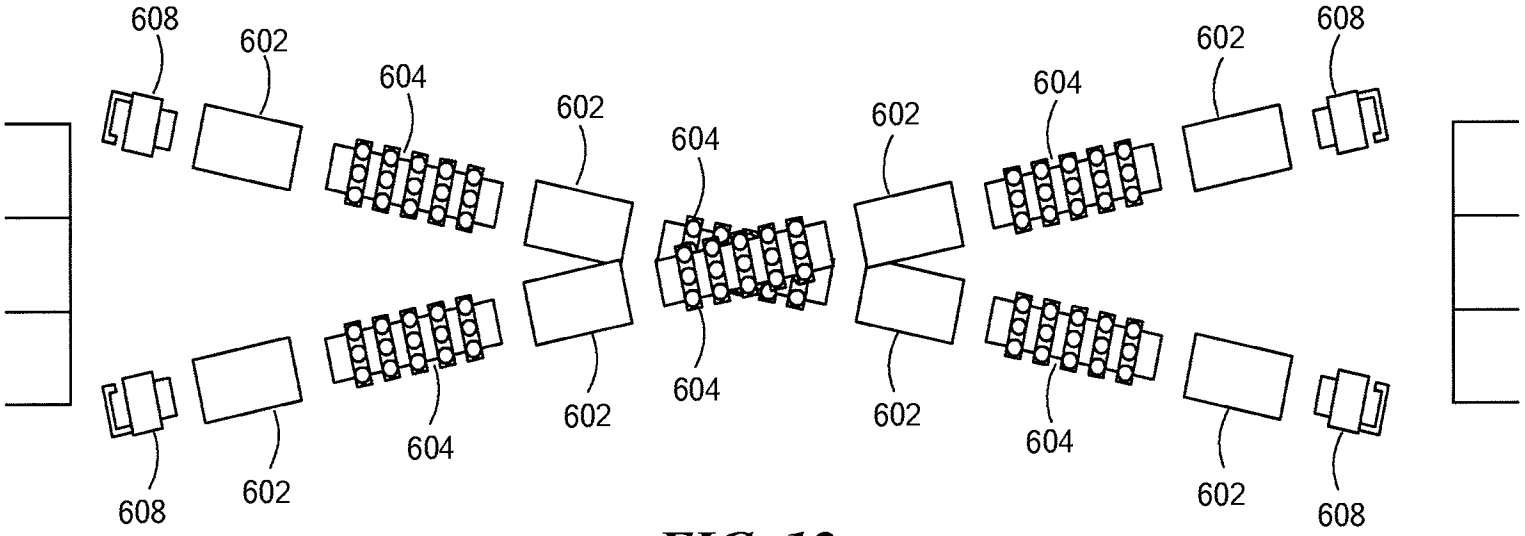
FIG. 12 shows a crisscross back band configuration that attaches to loops at the lateral sides of the bra cups.

FIG. 12 shows a crisscross back band configuration that attaches to loops at the lateral sides of the bra cups. Each band includes, from left to right, a male fastener segment 608, a F-F connector segment 602, a M-M chain segment 604, a F-F connector segment 602, a M-M chain segment 604, a F-F connector segment 602, a M-M chain segment 604, a F-F connector segment 602, and a male fastener segment 608.

Figure 13:
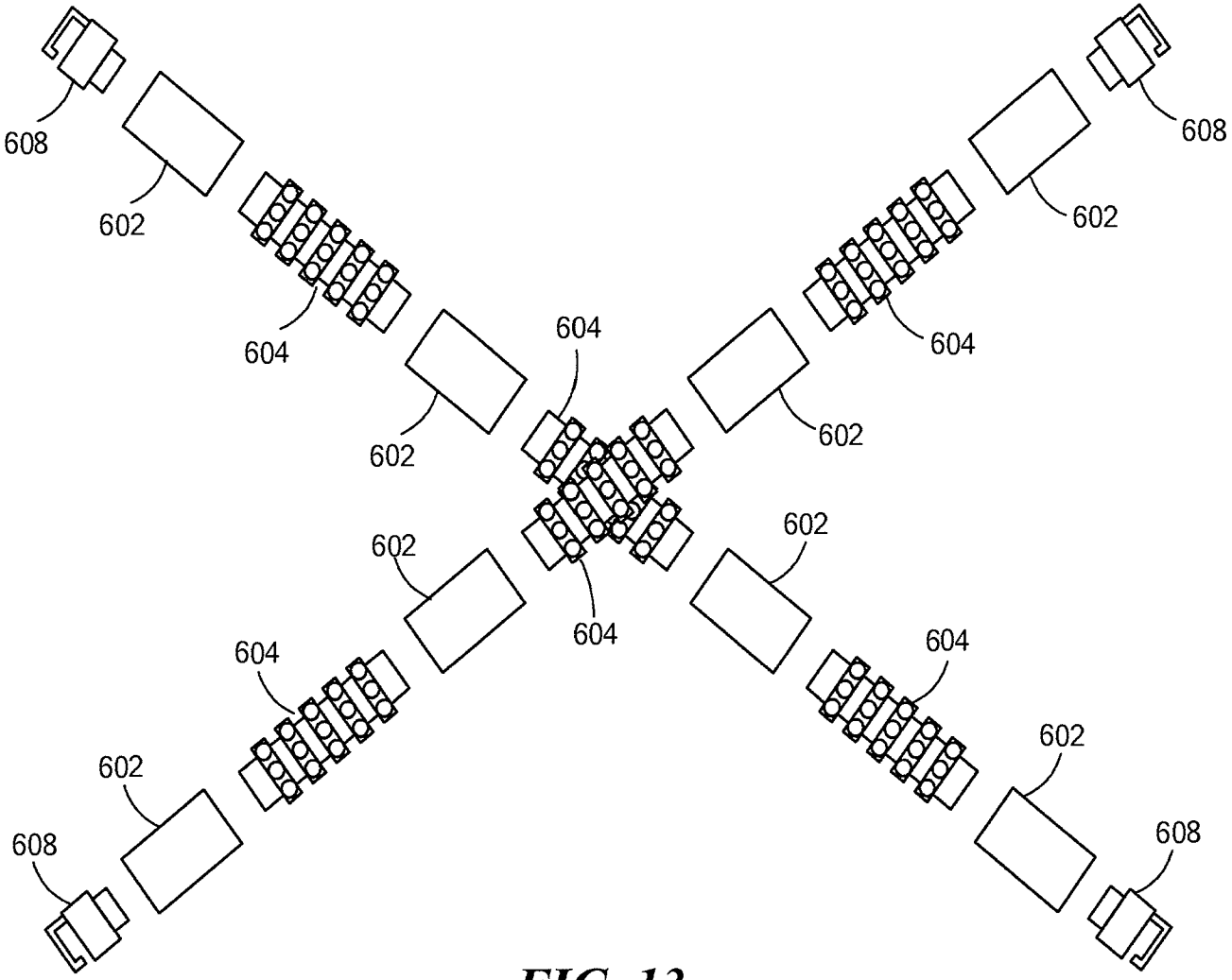
FIG. 13 shows a crisscross configuration that may be worn over the shoulders, with two fasteners attached at the back of the bra (e.g., to loops on the fabric back band or loops at the lateral sides of the cups) and two fasteners attached at the front of the bra.

FIG. 13 shows a crisscross configuration that may be worn over the shoulders, with two fasteners attached at the back of the bra (e.g., to loops on the fabric back band or loops at the lateral sides of the cups) and two fasteners attached at the front of the bra. Each band includes, from left to right, a male fastener segment 608, a F-F connector segment 602, a M-M chain segment 604, a F-F connector segment 602, a M-M chain segment 604, a F-F connector segment 602, a M-M chain segment 604, a F-F connector segment 602, and a male fastener segment 608.

Figure 14:
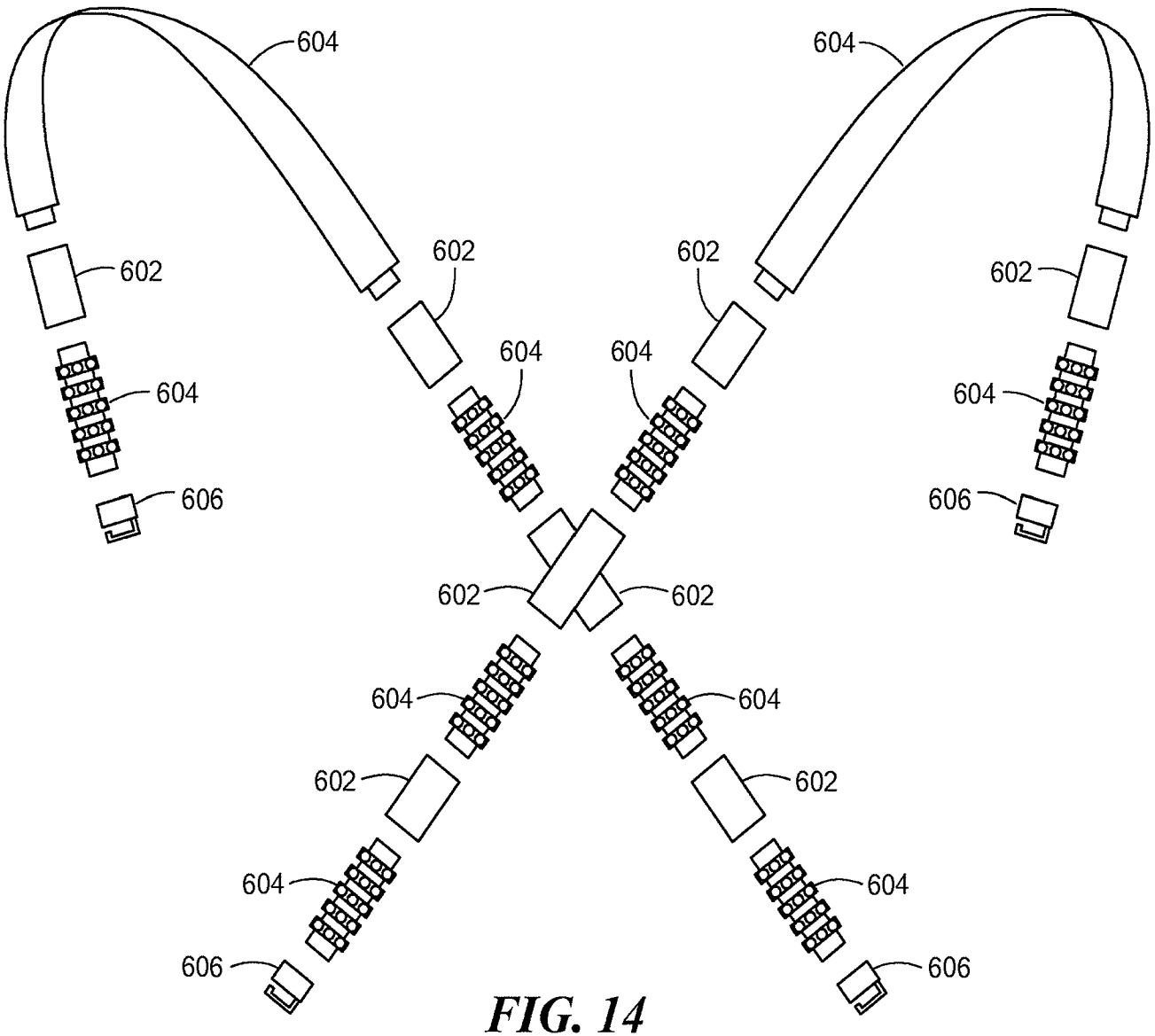
FIG. 14 shows an alternative crisscross configuration that may be worn over the shoulders as in FIG. 13.

FIG. 14 shows an alternative crisscross configuration that may be worn over the shoulders as in FIG. 13. Each band includes, starting from the bottom, a female fastener segment 606, a M-M chain segment 604, a F-F connector segment 602, a M-M chain segment 604, a F-F connector segment 602, a M-M chain segment 604, a F-F connector segment 602, a long M-M chain segment 604, a F-F connector segment 602, a M-M chain segment 604, and a female fastener segment 606.

Figure 15:
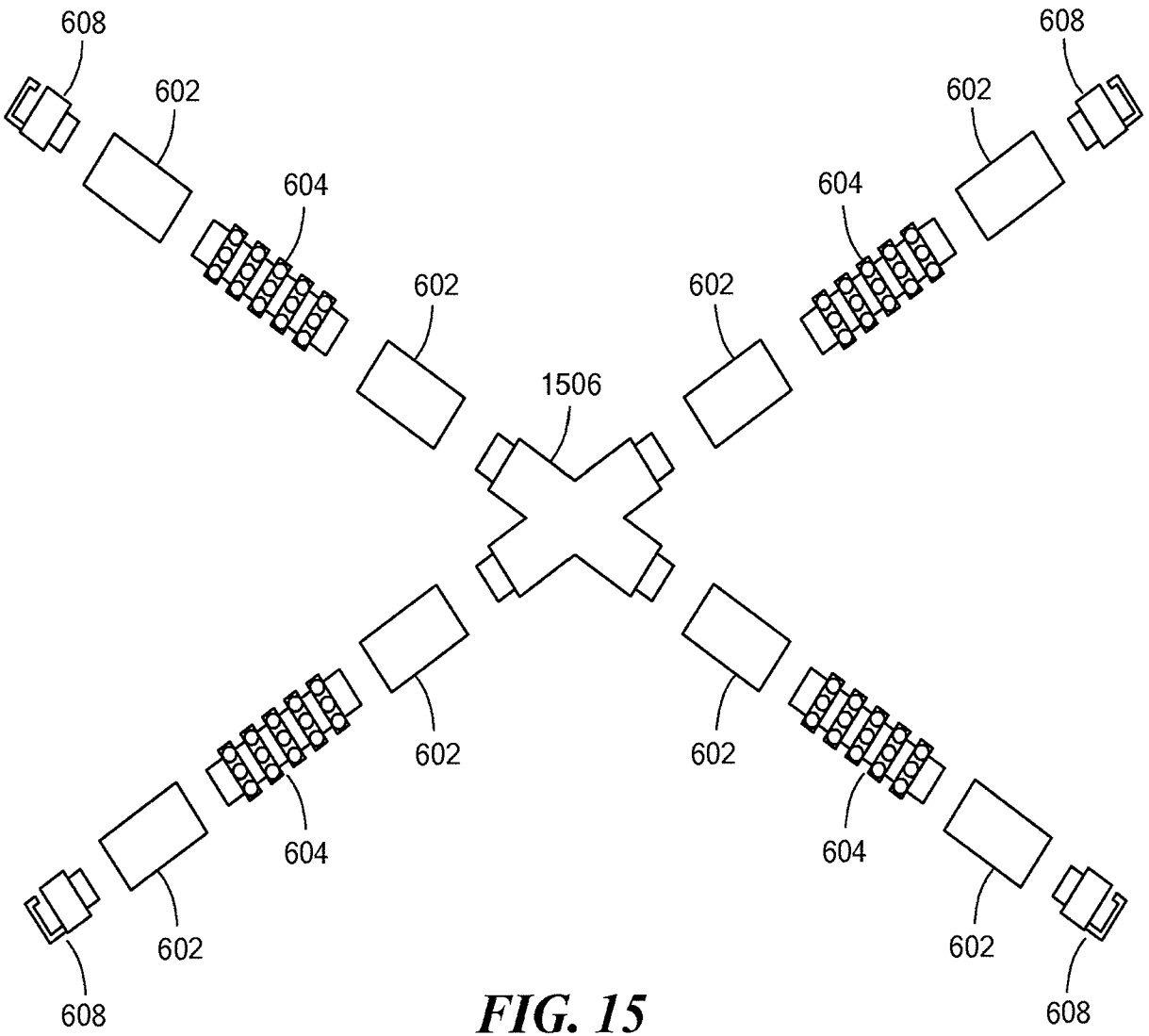
FIG. 15 shows still another crisscross configuration that may be worn over the shoulders as in FIG. 13, specifically using a cross-type connector segment with all male coupling elements coupled respectively to the female coupling element of a connector segment.

FIG. 15 shows still another crisscross configuration that may be worn over the shoulders as in FIG. 13, specifically using a cross-type connector segment 1506 with all male coupling elements coupled respectively to the female coupling element of a connector segment 602 at the end of each of four segments having a male fastener segment 608, a F-F connector segment 602, a M-M chain segment 604, and the F-F connector segment 602 that connects to the segment 1506.

Figure 16A:
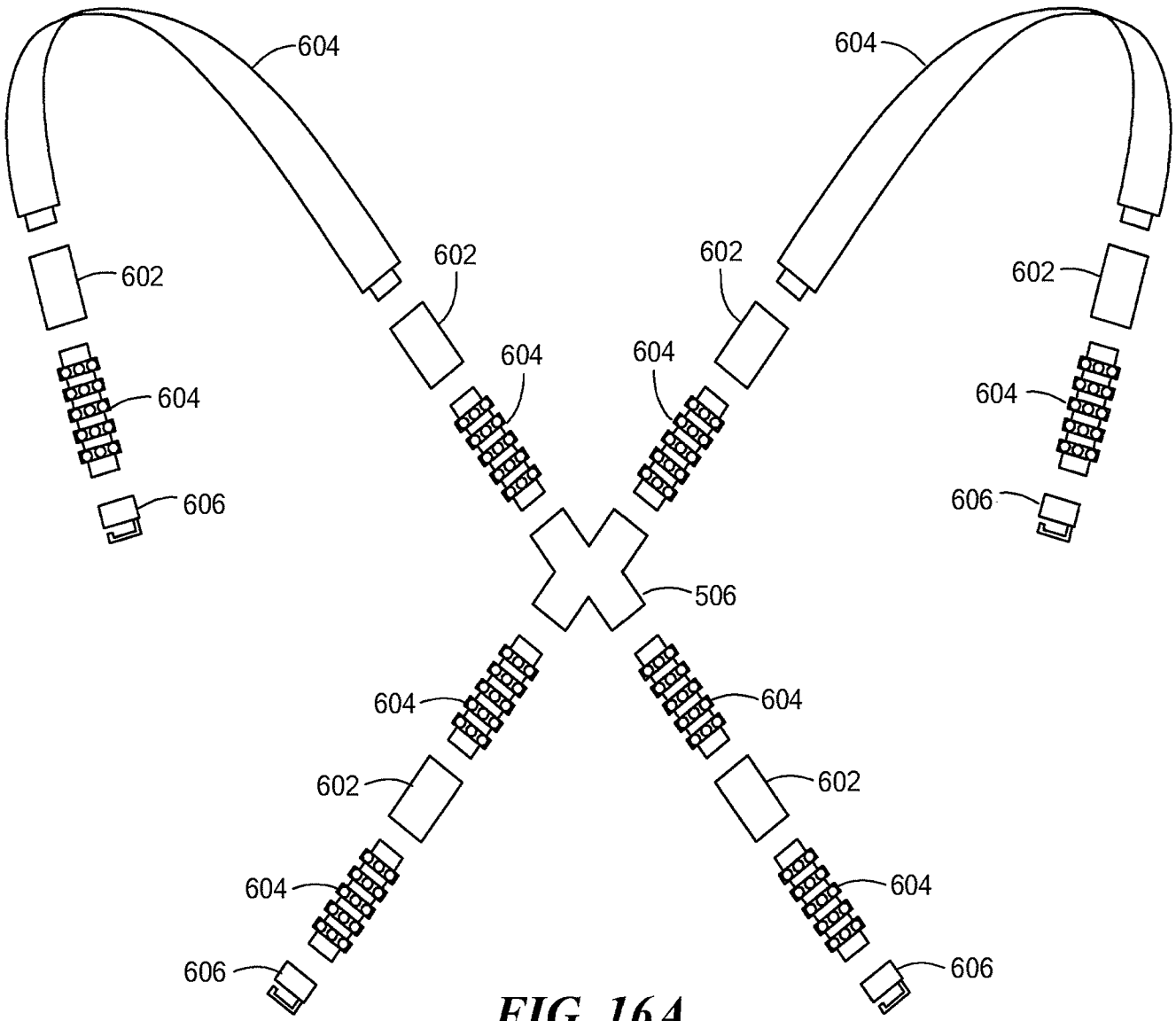
FIGS. 16A and 16B show still other crisscross configurations that may be worn over the shoulders as in FIG. 13, specifically using four-way connector segments all female coupling elements, each coupled to the male coupling element of a chain segment.
Figure 16B:
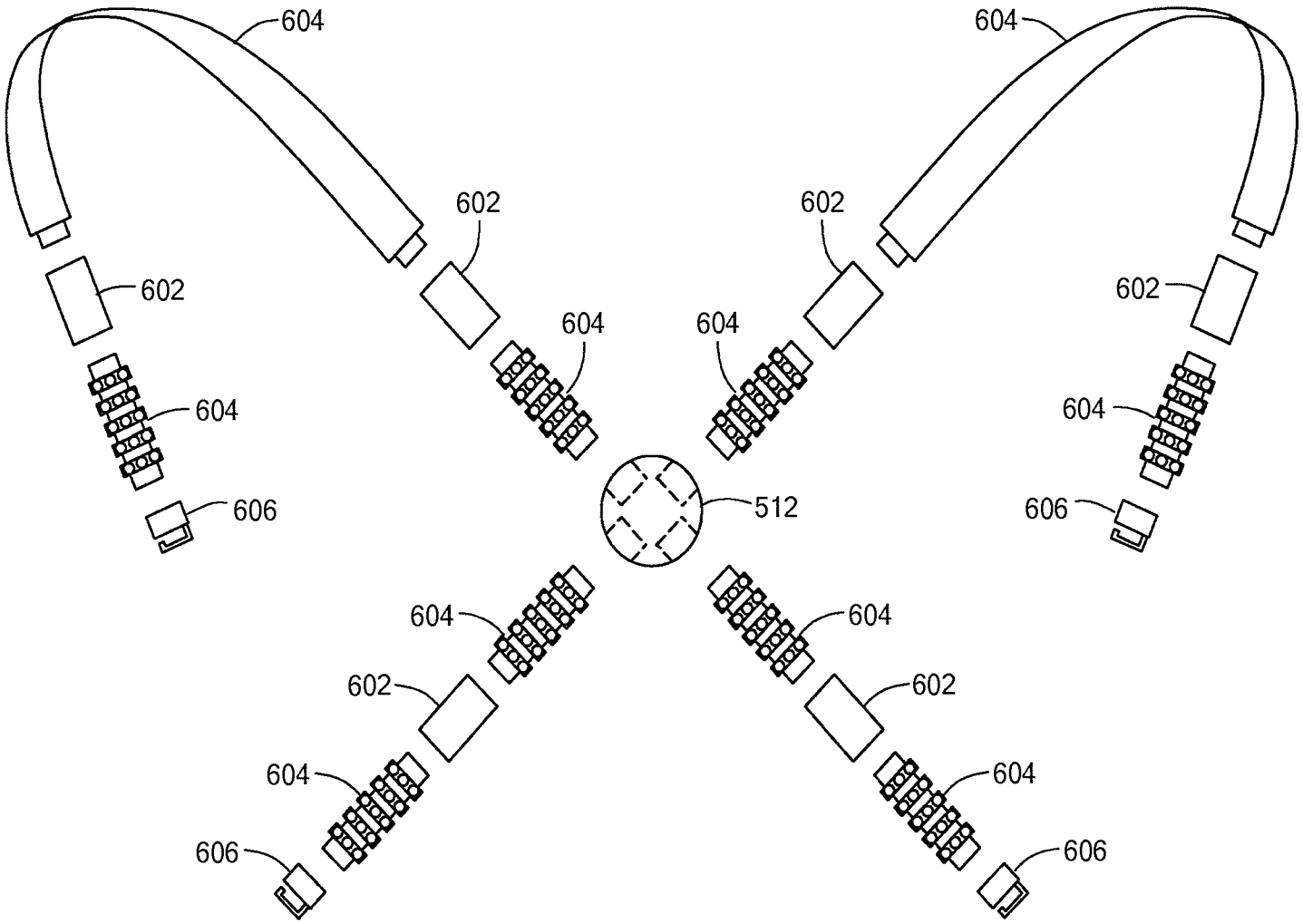

FIGS. 16A and 16B show still other crisscross configurations that may be worn over the shoulders as in FIG. 13, specifically using four-way connector segments 506, 512 including all female coupling elements, each coupled to the male coupling element of a chain segment 604 at the end of each of four segments having alternating M-M chain segments 604 and F-F connector segments 602 and terminating with a female fastener segment 606.

Figure 17:
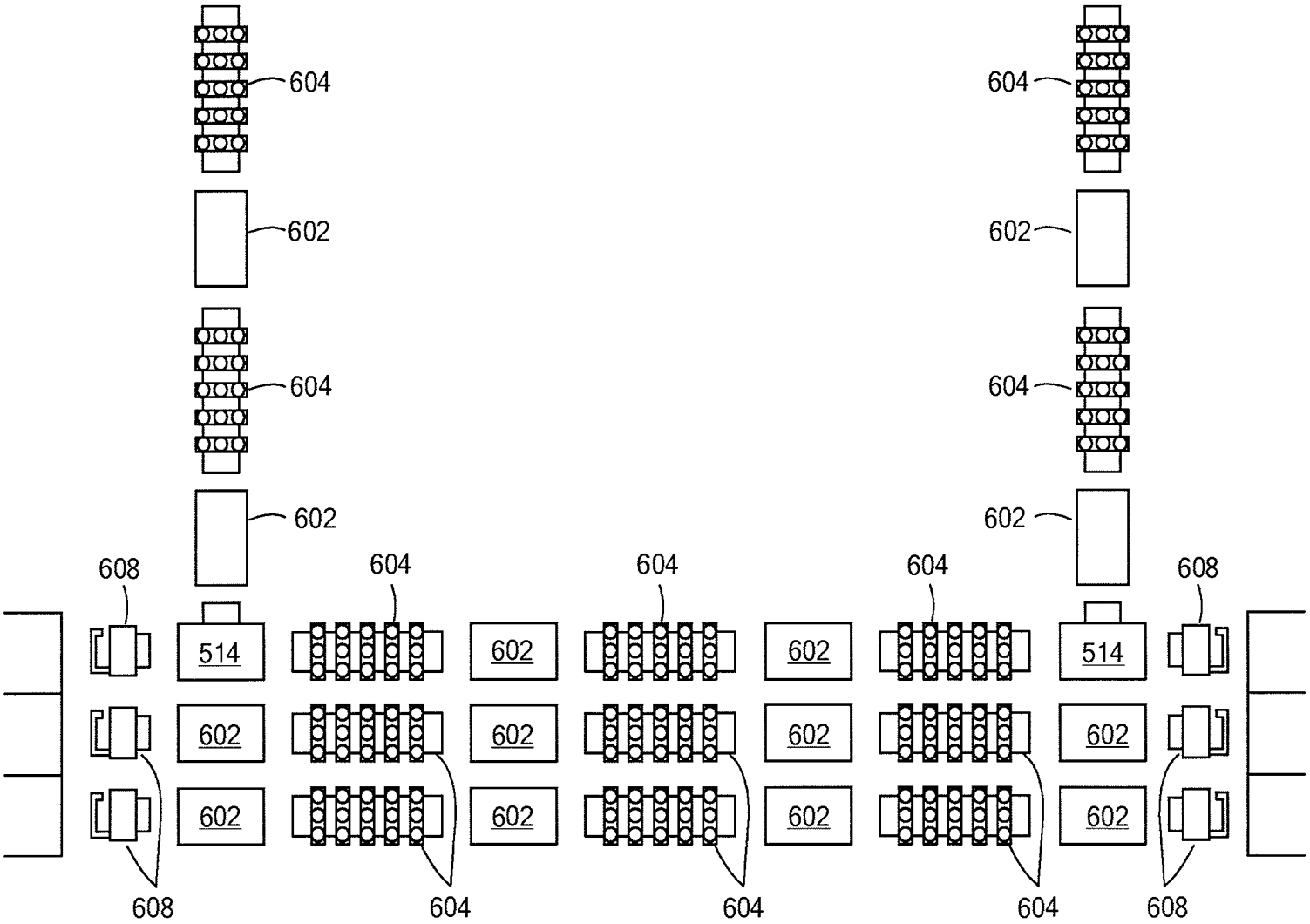
FIG. 17 shows a configuration including a back band with integral shoulder straps using "T" connector segments having opposing female coupling elements oriented along the band and a male coupling element for the strap.

FIG. 17 shows a configuration including a back band with integral shoulder straps using "T" connector segments 514 having opposing female coupling elements oriented along the band and a male coupling element for the strap. The shoulder straps would attach at the front of the bra, e.g., using hook-type fastener segments (not shown for convenience). Specifically, the back band includes, from left to right, a male fastener segment 608, a "T" connector segment 514, a M-M chain segment 604, a F-F connector segment 602, a M-M chain segment 604, a F-F connector segment 602, a M-M chain segment 604, a "T" connector segment 514, and a male fastener segment 608. Each strap includes, from the bottom, a F-F connector segment 602 that connects to the "T" connector segment 514, a M-M chain segment 604, a F-F connector segment 602, a M-M chain segment 604, and so on. The back band with integral shoulder straps is shown here with two additional matching back bands that attach to the bra (e.g., to standard bra loops provided on the wing sections of the bra cups) using hook-type fastener segments. Each of these additional matching back bands includes, from left to right, a male fastener segment 608, a F-F connector segment 602, a M-M chain segment 604, a F-F connector segment 602, a M-M chain segment 604, a F-F connector segment 602, a M-M chain segment 604, a F-F connector segment 602, and a male fastener segment 608.

Figure 18A:
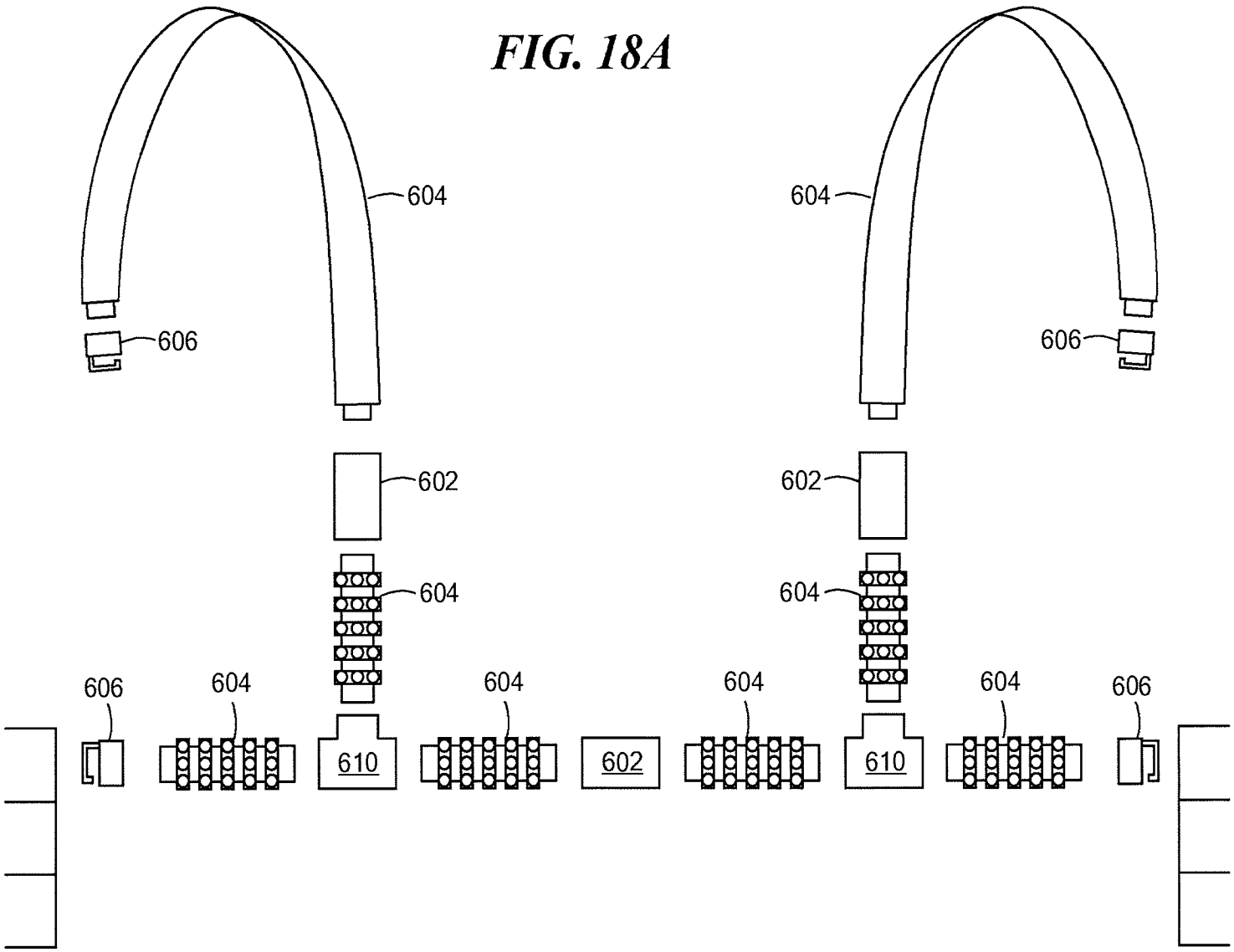

FIGS. 18A-18C show configurations including a back band with integral shoulder straps using "T" connector segments 610 having all female coupling elements. The shoulder straps would attach at the front of the bra, e.g., using hook-type fastener segments. The back band with integral shoulder straps is shown alone in FIG. 18A, with one additional matching back band in FIG. 18B, and with two additional matching back bands in FIG. 18C. Specifically, in FIG. 18A, the back band includes, from left to right, a female fastener segment 606, a M-M chain segment 604, a "T" connector segment 610, a M-M chain segment 604, a F-F connector segment 602, a M-M chain segment 604, a "T" connector segment 610, a M-M chain segment 604, and a female fastener segment 606, while each strap includes, from the bottom, a M-M chain segment 604 that connects to the "T" connector segment 610, a F-F connector segment 602, a long M-M chain segment 604, and a female fastener segment 606. In FIGS. 18B and 18C, each of the additional matching back bands includes, from left to right, a female fastener segment 606, a M-M chain segment 604, a F-F connector segment 602, a M-M chain segment 604, a F-F connector segment 602, a M-M chain segment 604, a F-F connector segment 602, a M-M chain segment 604, and a female fastener segment 606.

Figure 19:
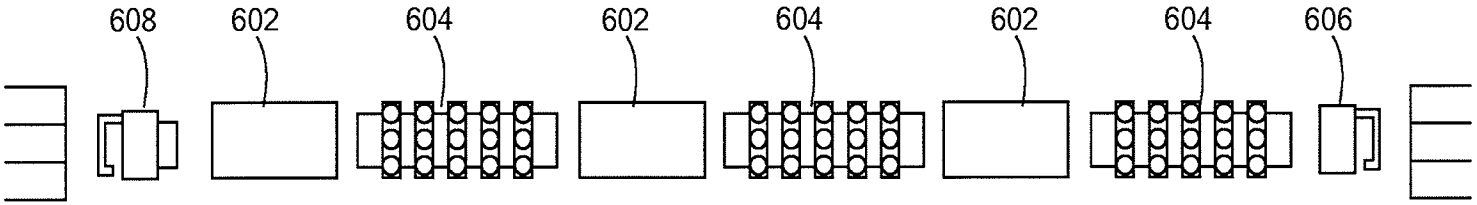
FIG. 19 shows back band that has wider flexible chain and wider solid connectors and wider hooks that connect into loops at the lateral sides of the bra cups.

FIG. 19 shows back band that has wider flexible chain and wider solid connectors and wider hooks that connect into loops at the lateral sides of the bra cups. Even though the bra cups have multiple loops (in this case three loops), the large hook can slide through all three loops at one time. Bands may be produced in different widths, with hooks that slide through one loop, two loops, three loops, etc. Specifically, the band includes, from left to right, a wide male fastener segment 608, a wide F-F connector segment 602, a wide M-M chain segment 604, a wide F-F connector segment 602, a wide M-M chain segment 604, a wide F-F connector segment 602, a wide M-M chain segment 604, and a wide female fastener segment 606.

Figure 20:
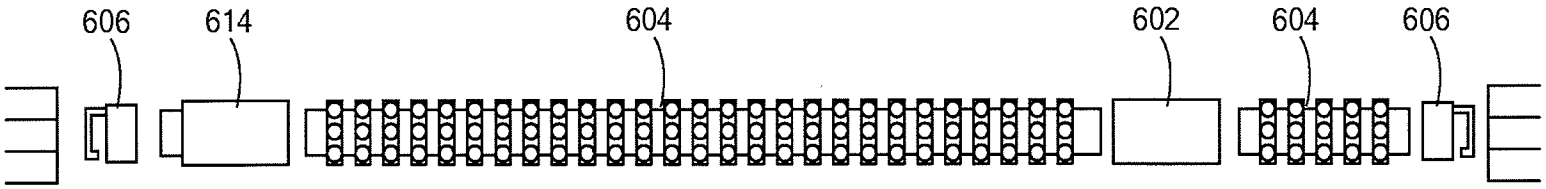
FIG. 20 shows a strap/band configuration including a long chain segment.

FIG. 20 shows a strap/band configuration including a long chain segment. This strap/band configuration includes, from left to right, a female fastener segment 606, a M-F connector segment 605, a long M-M chain segment 604, a F-F connector segment 602, a M-M chain segment 604, and a female fastener segment 606.

Figure 21:
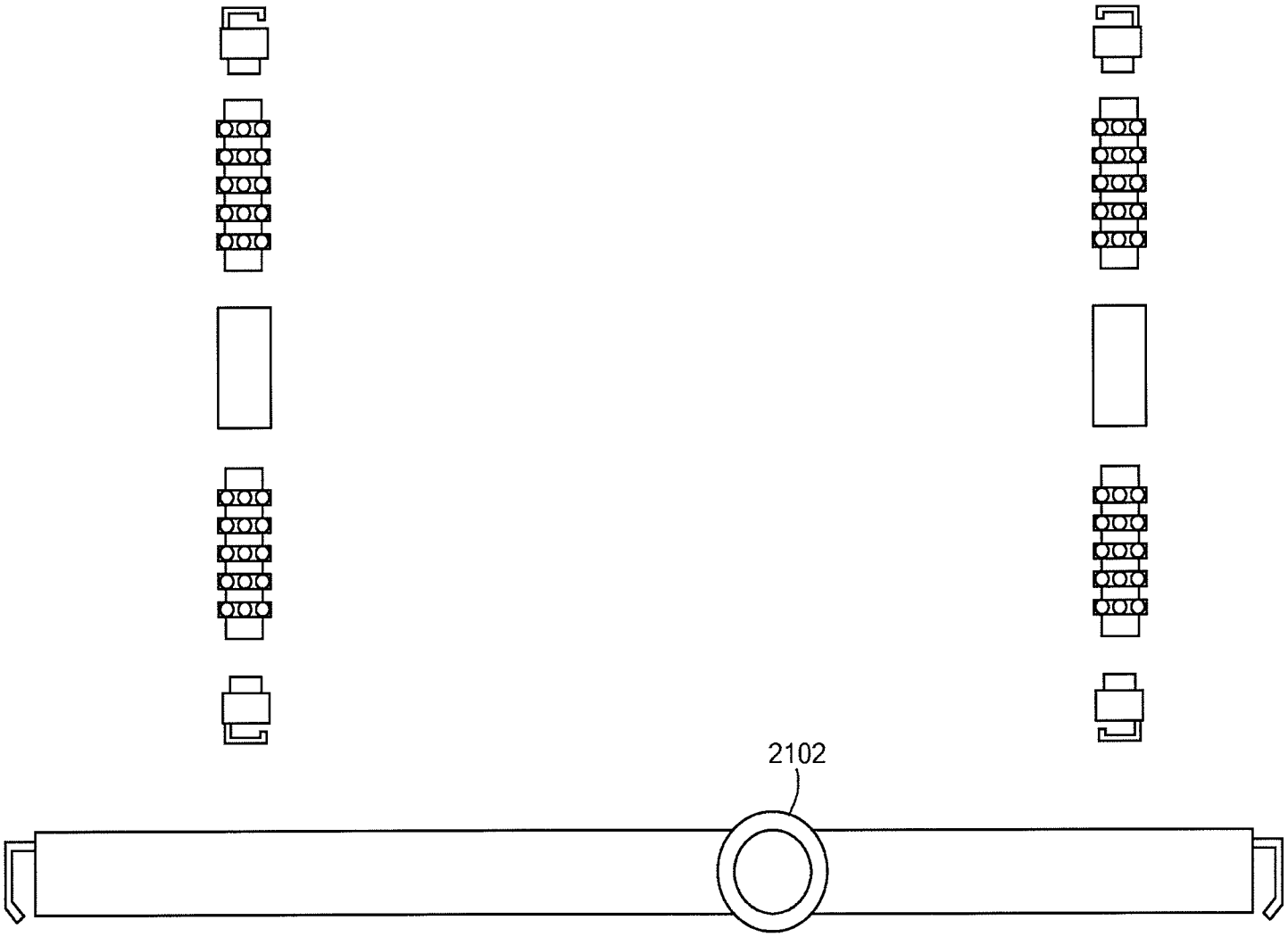
FIG. 21 shows sectional shoulder straps that attach to the fabric band of a bra.

FIG. 21 shows sectional shoulder straps that attach to the fabric band of a bra. Here, the fabric band does not adjust with hook and eye, but instead uses an adjuster slide 2102 that makes the band longer or shorter and is hooked to the loops on lateral sides of the bra cups with traditional bra hooks. As discussed below, additional decorative or ornamental slides can be added to the back band, and the back band may have loops arranged along the top and/or bottom edges or elsewhere to which the straps may attach.

Figure 22:
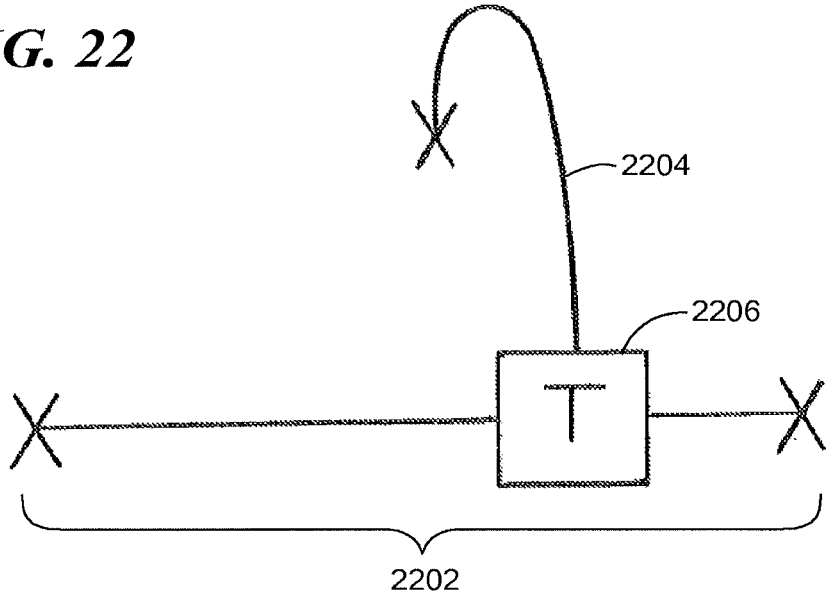
FIG. 22 shows a configuration having a back band and single shoulder strap via a single "T" connector segment.

FIG. 22 schematically shows a configuration having a back band 2202 and single shoulder strap 2204 via a single "T" connector segment 2206.

Figure 23:
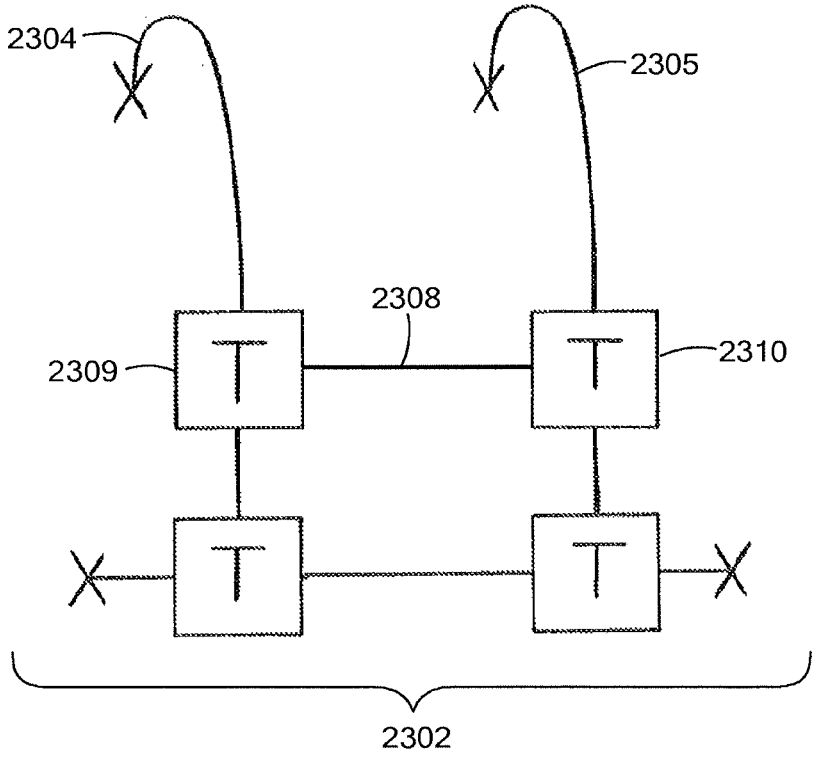
FIG. 23 shows a configuration having a back band, two shoulder straps, and an additional decorative back strap that is formed by replacing one two-way connector segment of each strap with a three-way "T" connector segment and forming the decorative back strap between the added "T" connector segments.

FIG. 23 schematically shows a configuration having a back band 2302, two shoulder straps 2304, 2305, and an additional decorative back strap 2308 that is formed by replacing one two-way connector segment of each strap 2304, 2305 with a three-way "T" connector segment 2309, 2310 and forming the decorative back strap 2308 between the added "T" connector segments.

A sectional bra strap/band may incorporate design elements from the inventor's design Pat. No. D587,433, which is hereby incorporated by reference in its entirety.

Sectional Bra

As discussed above, sectional bras may be provided with various arrangements of standard bra loops to allow for attaching straps, bands, bridges, and/or other items such as decorative segments to the bra. For example, bras may be provided with loops at the upper edges of the bra cups and/or at the bridge for attachment of one or more bra straps, may be provided with loops at the lateral sides of the bra cups for attachment of one or more back bands, and/or may be provided with loops at the inner edges of the bra cups for attachment of a removable bridge. Thus, in such embodiments, the bra cups may be completely separate from the straps, band, and bridge. Components of the type shown in FIG. 4 may be used to form the straps, band, and/or bridge, thus providing a completely sectional bra system with a common set of components used to form the straps, band, and/or bridge.

Figure 27:
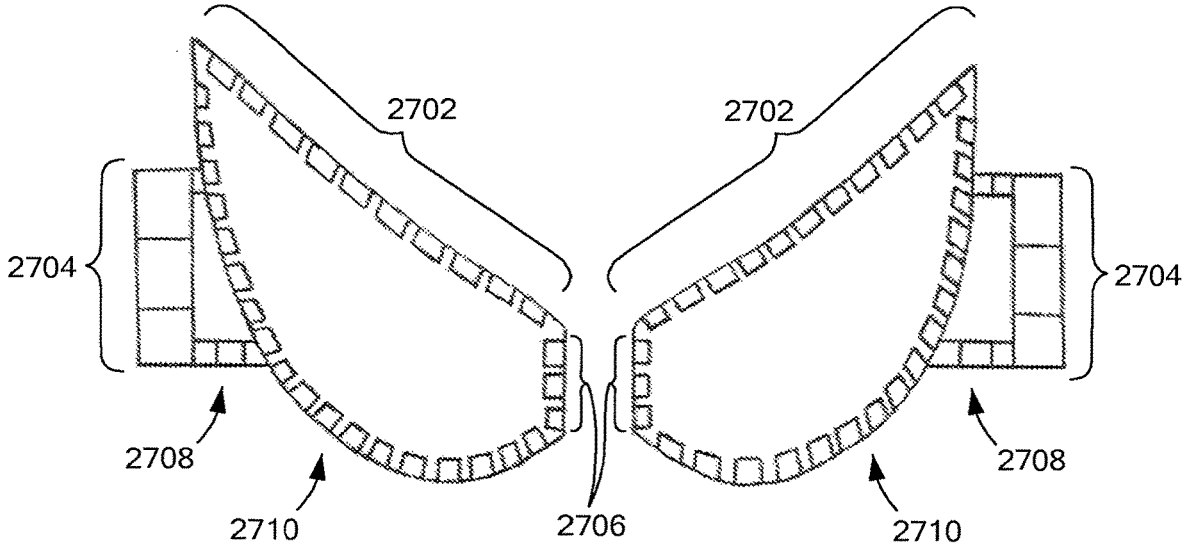
FIG. 27 shows an exemplary bra configured with strap, bridge, and band loops.

FIG. 27 shows an exemplary bra configured with strap loops 2702, bridge loops 2706, and band loops 2704. Here, the band loops 2704 are located on wing portions 2708 that are integral or attached to the cups 2710, although band loops could be included directly on the bra cups and/or on wing portions as shown. The loops are configured to permit attachment by a traditional bra hook, although, as discussed above, other hook arrangements may slide through more than one loop.

Figure 28:
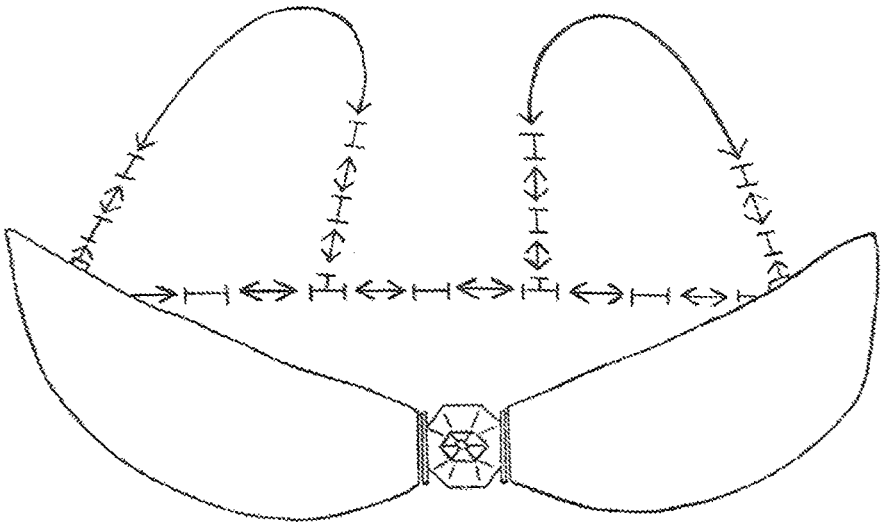
FIG. 28 shows the bra of FIG. 27 with a bridge segment, shoulder straps, and back band attached to the bra.

FIG. 28 shows the bra of FIG. 27 with a bridge segment, shoulder straps, and back band attached to the bra. Just as the components of the straps/band are sectional and can be sold individually and/or in kits, the other components, including the bra cups and bridge segments can be sold individually and/or in kits.

Figure 32:
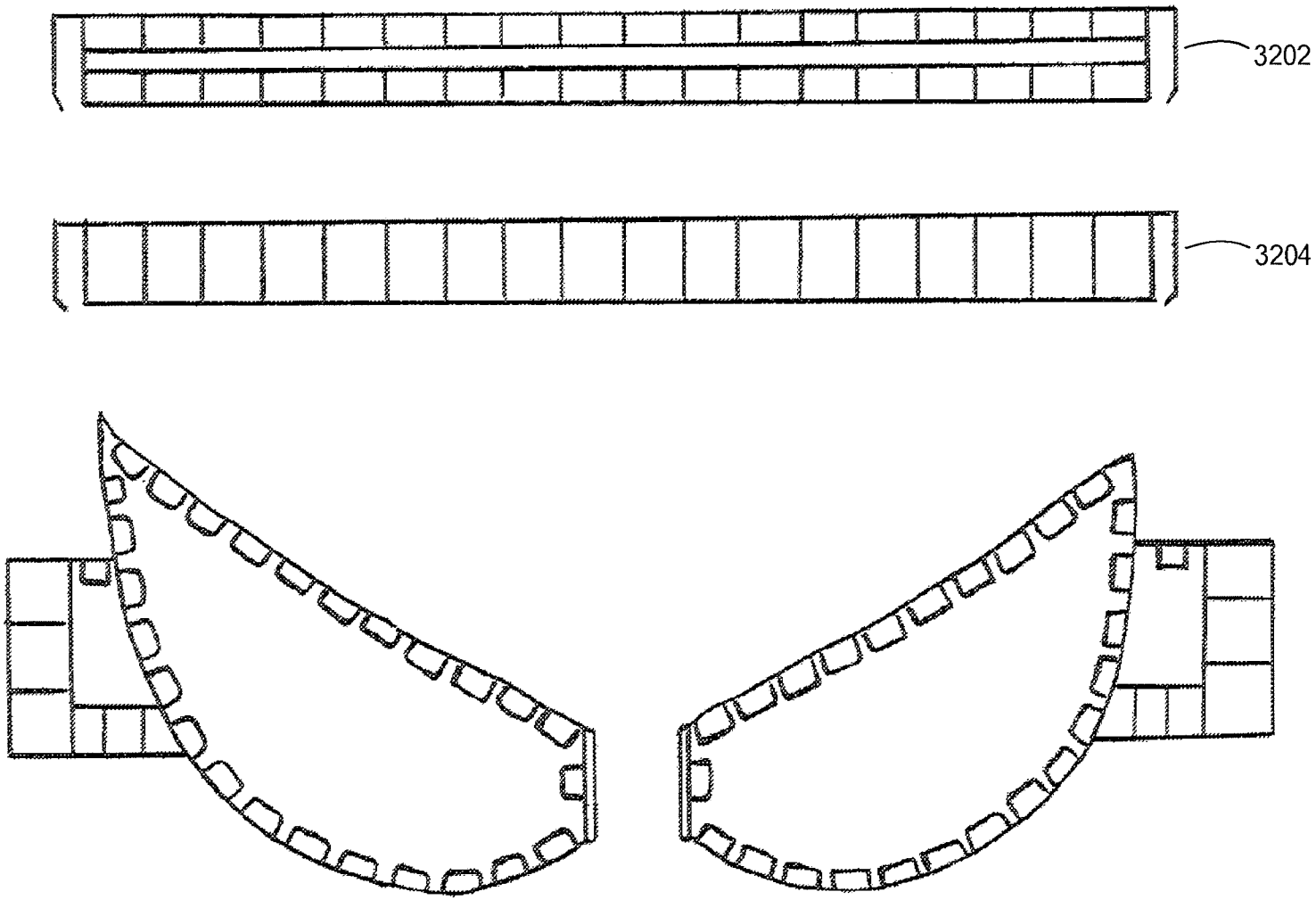
FIG. 32 shows an alternative bra configured with loops along the outer perimeter of the cups, along the outer edges of the cup wings, and across the fabric back band.

FIG. 32 shows an alternative bra configured with loops along the entire perimeter of the bra cups (including along the outer perimeter of the cups and along the outer edges of the cup wings) and along the fabric back band (two back band configurations are shown, one 3202 having loops across the top and bottom of the back band, the other 3204 having one set of loops across the entire band).

Figure 29:
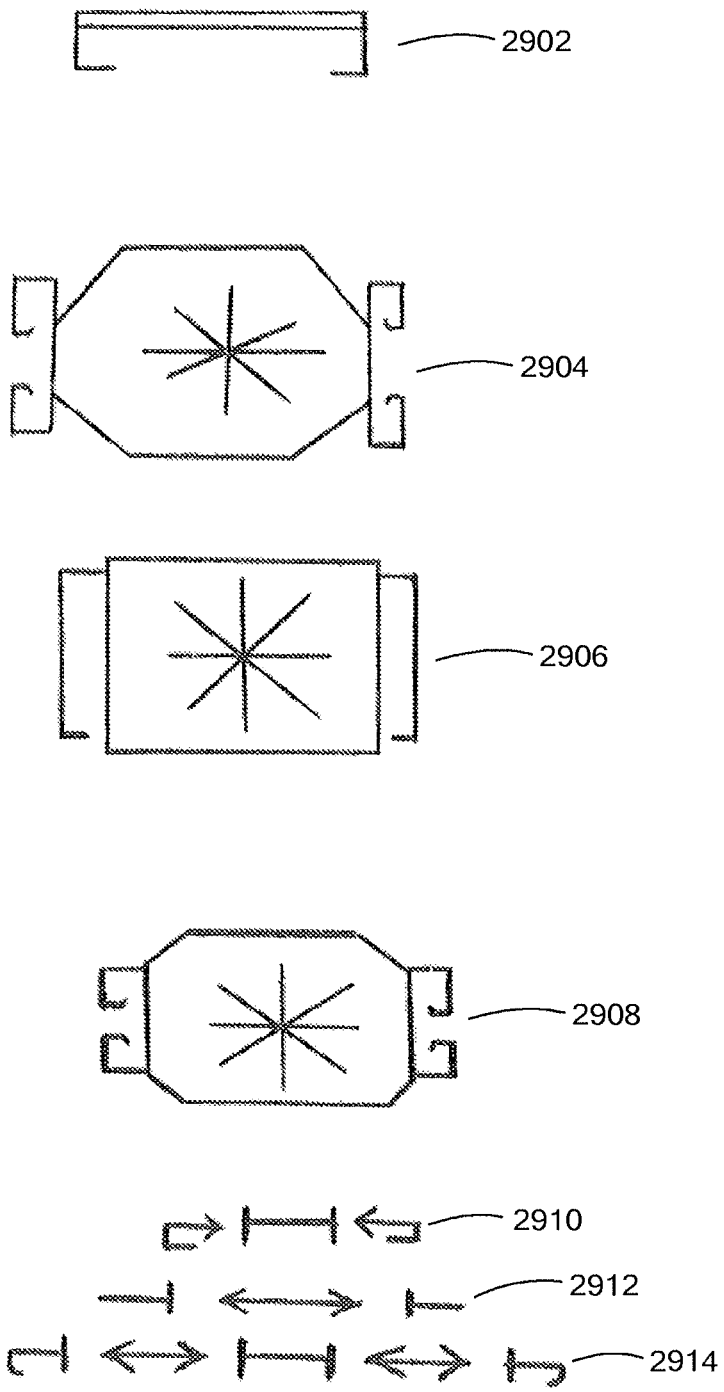
FIG. 29 shows some exemplary bridge segments for bras of the types shown in FIGS. 27 and 32.

FIG. 29 shows some exemplary bridge segments for bras of the types shown in FIGS. 27 and 32. Bridge segment 2902 is a simple bar with a hook at both ends. Bridge segment 2904 is a configured to look like a brooch, with two hooks on each side to attach to two loops on each bra cup. Bridge segment 2906 is similar to bridge segment 2904 but includes a single elongated hook on each side to slide through multiple loops on each bra cup. Bridge segment 2908 is similar to bridge segment 2904 but has a different shaped brooch. The bridge segments 2910-2914 are sectional and are formed from the same types of components shown in FIG. 4 (e.g., the bridge segment 2910 includes a female-female segment with two male fastener segments; the bridge segment 2912 includes a male-male segment with two female fastener segments; and the bridge segment 2914 includes a female-female segment, two male-male segments, and two fastener segments).

Figure 30:
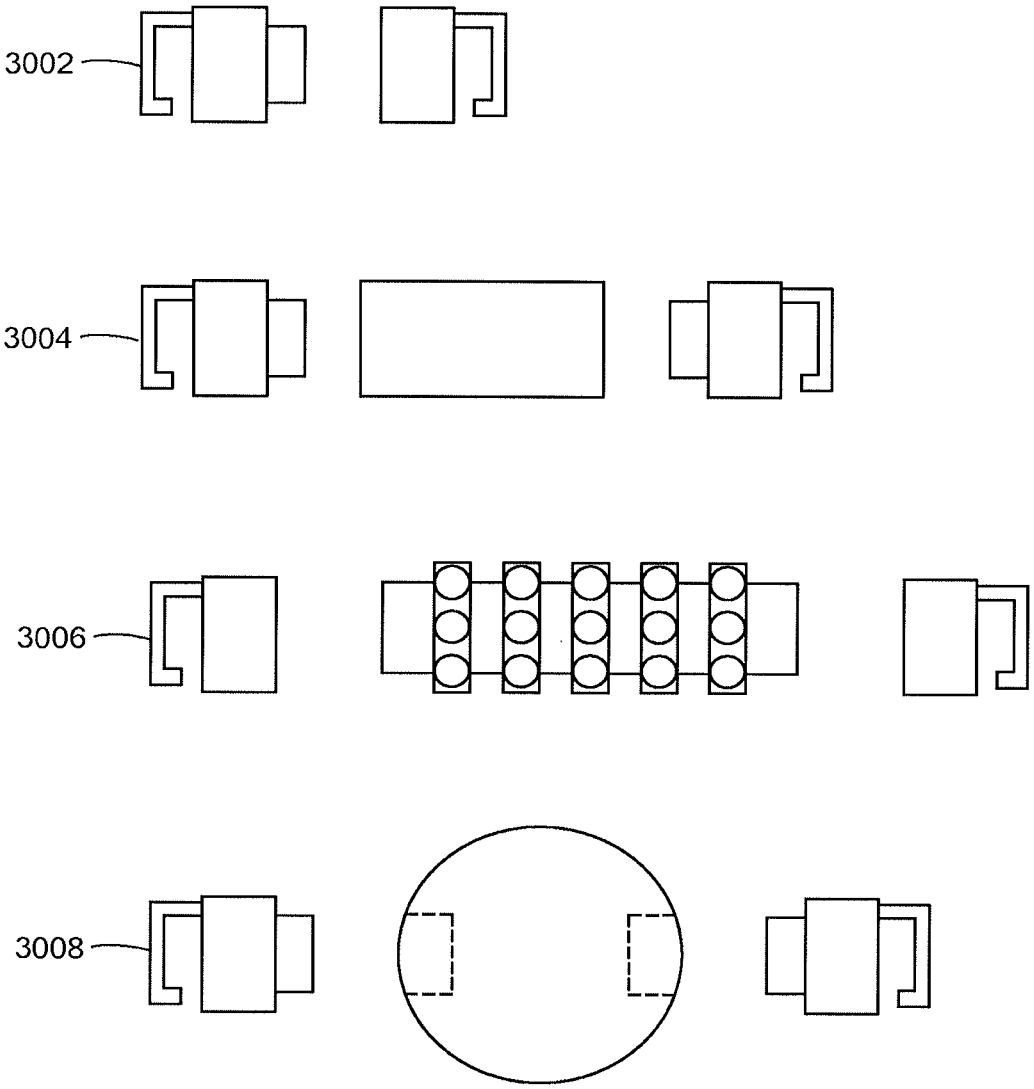
FIG. 30 shows some additional exemplary sectional bridge segments for bras of the types shown in FIGS. 27 and 32.

FIG. 30 shows some additional exemplary sectional bridge segments. Bridge segment 3002 includes two fastener segments connected together. Bridge segment 3004 specifically includes a female-female connector segment and two male fastener segments. Bridge segment 3006 specifically includes a male-male chain segment and two female fastener segments. Bridge segment 3008 includes a circular two-way connector segment and two male fastener segments.

Figure 31:
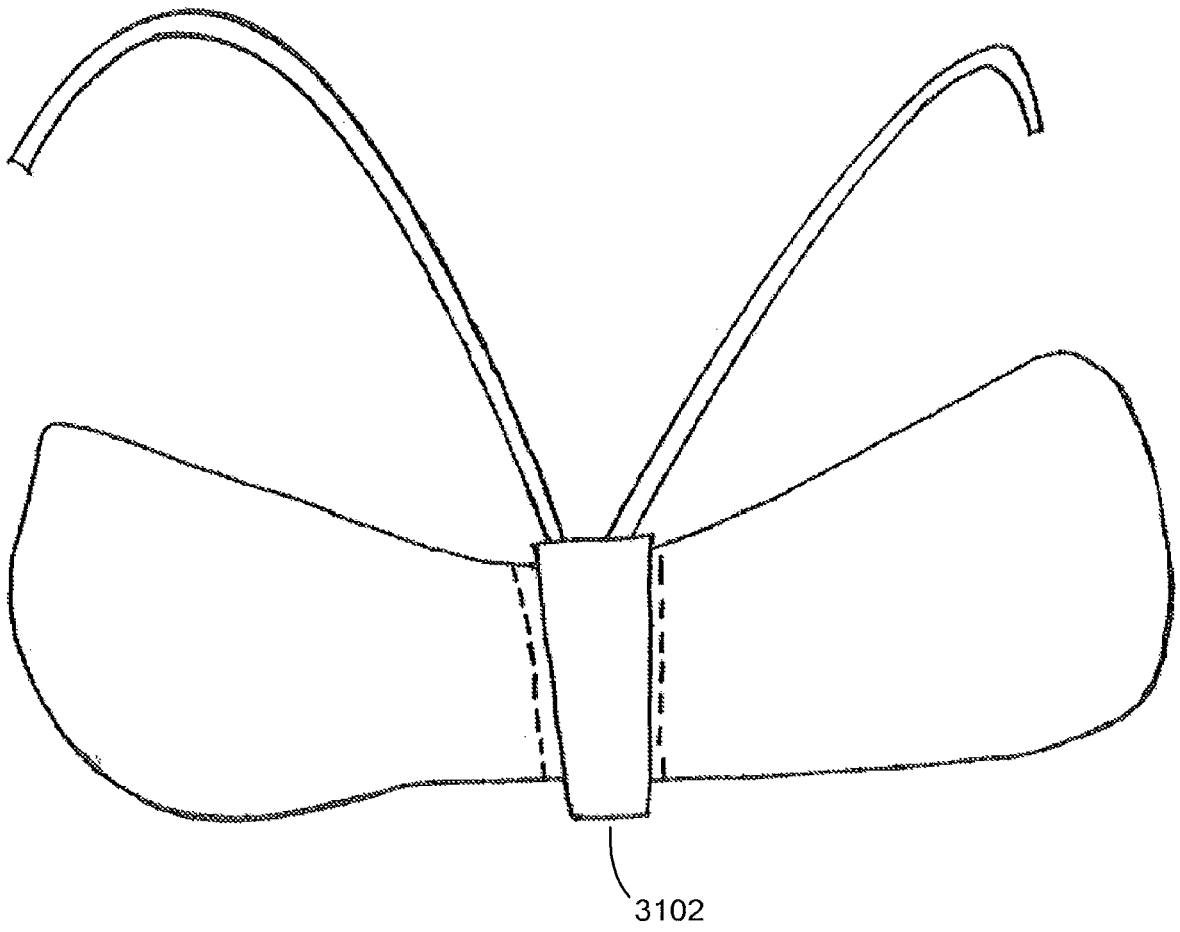
FIG. 31 schematically shows a configuration in which straps connect to a bridge segment that either attaches at the existing bridge of a bra or attaches to the loops of a bra.

FIG. 31 schematically shows a configuration in which straps connect to a bridge segment 3102 that either attaches at the existing bridge of a bra or attaches to the loops of a bra. The bridge segment 3102 may include loops to which straps with hooks can be attached, or the bridge segment 3102 may include male coupling elements and/or female coupling elements to which other sectional jewelry components of the type shown in FIG. 4 may be coupled. Thus, for example, an integral arrangement including bra strap(s), band(s), and bridge can be formed.

It should be noted that other types of bridge segments may be provided including embellished or plain fabric or any other material, including but not limited to, metal, plastic, and chain. For example, a conventional-looking fabric bridge may be provided with appropriate hooks for attachment to the bridge loops of the sectional bra.

Similarly, the back band can be replaced with any type of band including embellished or plain fabric or any other material, including but not limited to, metal, plastic, chain. The back band may be provided with loops (e.g., along the top and/or bottom edges) to which one or more straps can be attached.

Also, the straps can be replaced with any type of strap including embellished or plain fabric or any other material, including but not limited to, metal, plastic, chain. For example, fixed-length straps of the type sold by SOS may be used.

Figure 24:
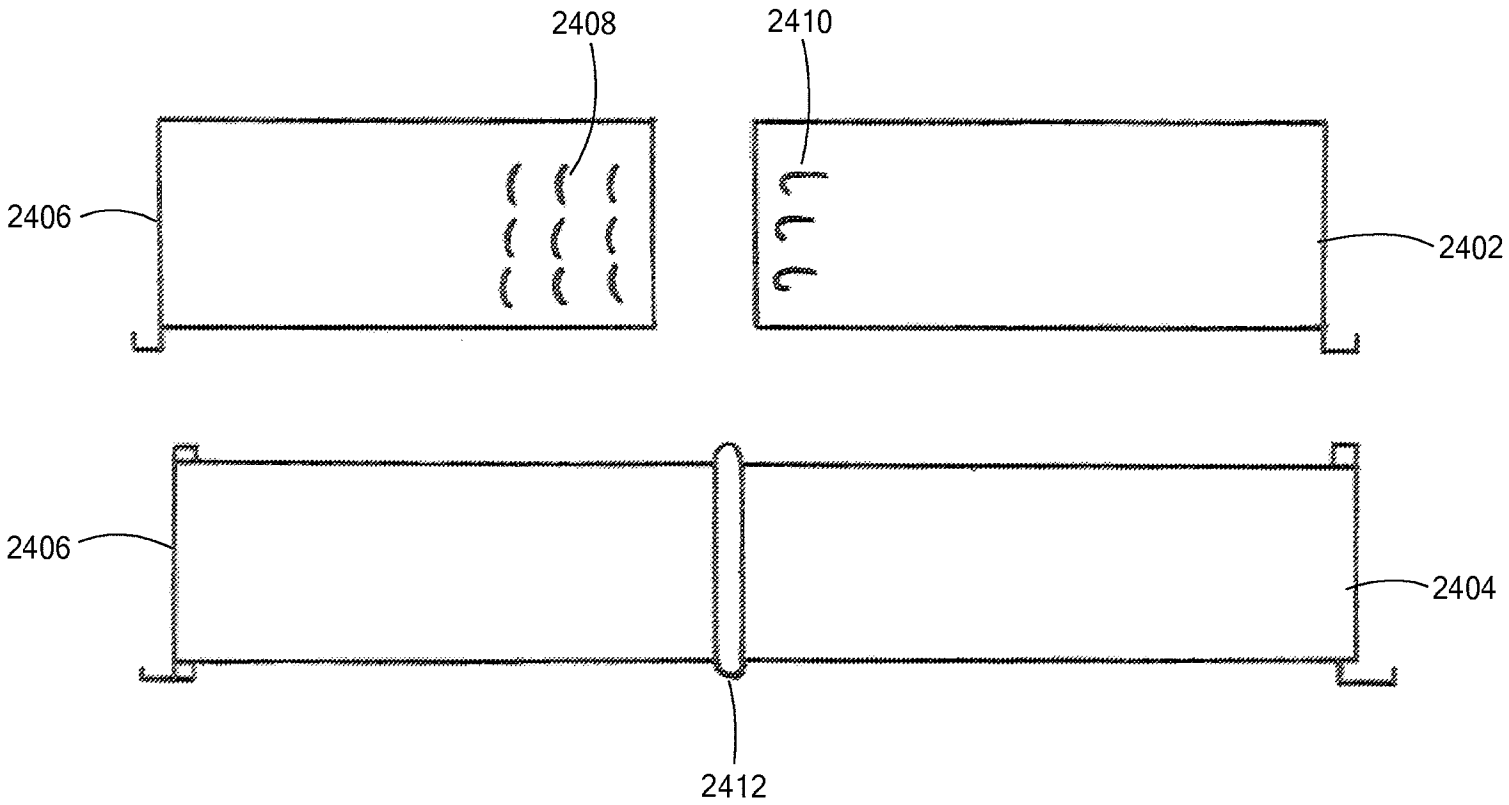
FIG. 24 shows two versions of interchangeable fabric bands that may be used on the bras shown in FIGS. 27 and 32.

FIG. 24 shows two versions of interchangeable fabric bands that may be used on the bras shown in FIGS. 27 and 32. Band 2402 includes two pieces that attach with traditional bra hooks 2406 to the bra's standard bra loops and includes hook and eye connectors 2408, 2410 for size adjustment like a traditional band. These connectors may be covered by a piece of jewelry that hooks onto or slides over the connectors. Band 2404 is one piece and has a slide 2412 in the center that adjusts the size of the band.

Figure 25:
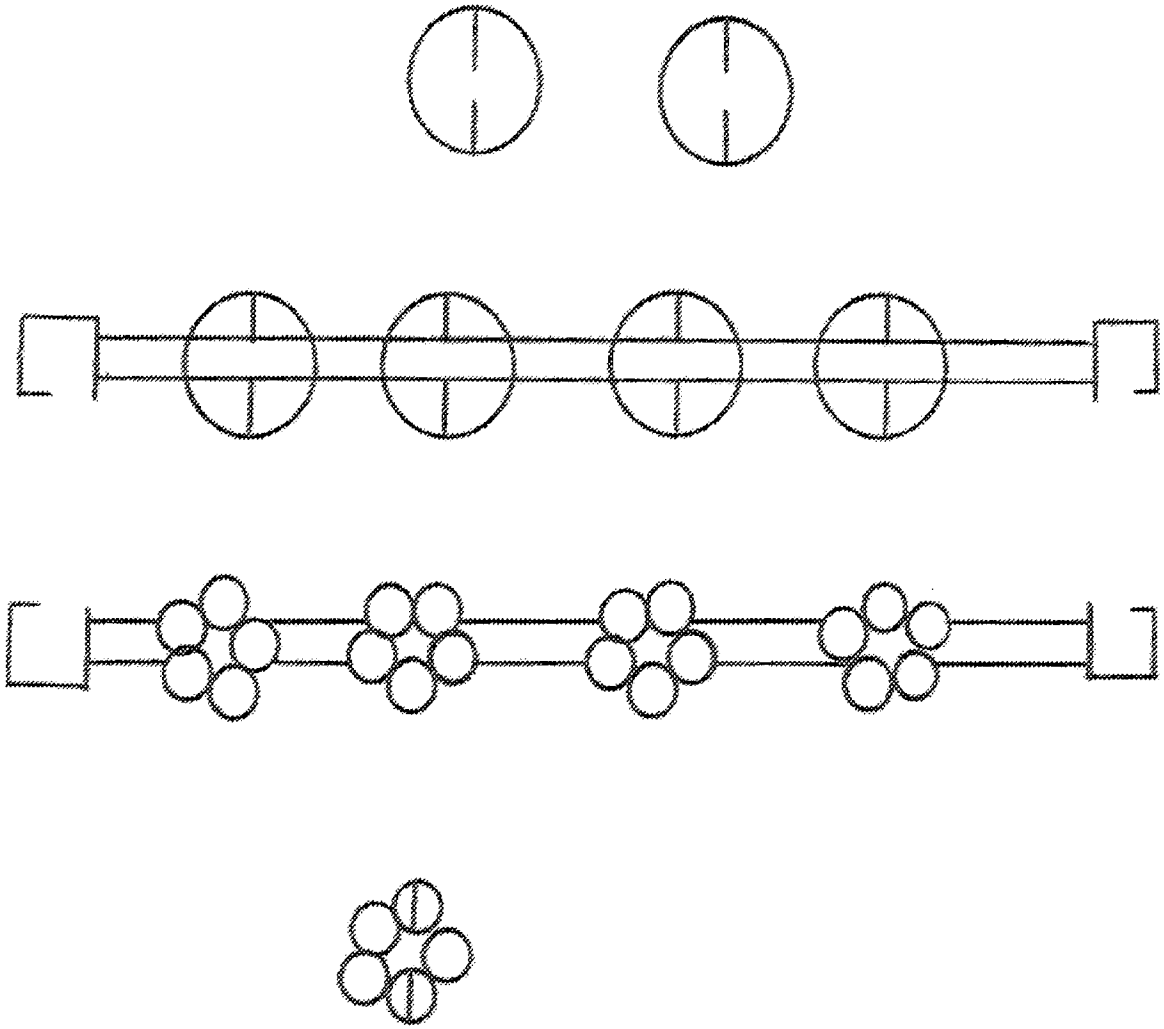
FIG. 25 shows alternative fabric bra straps and/or back bands with decorative slides that attach to the strap/band.
Figure 26:
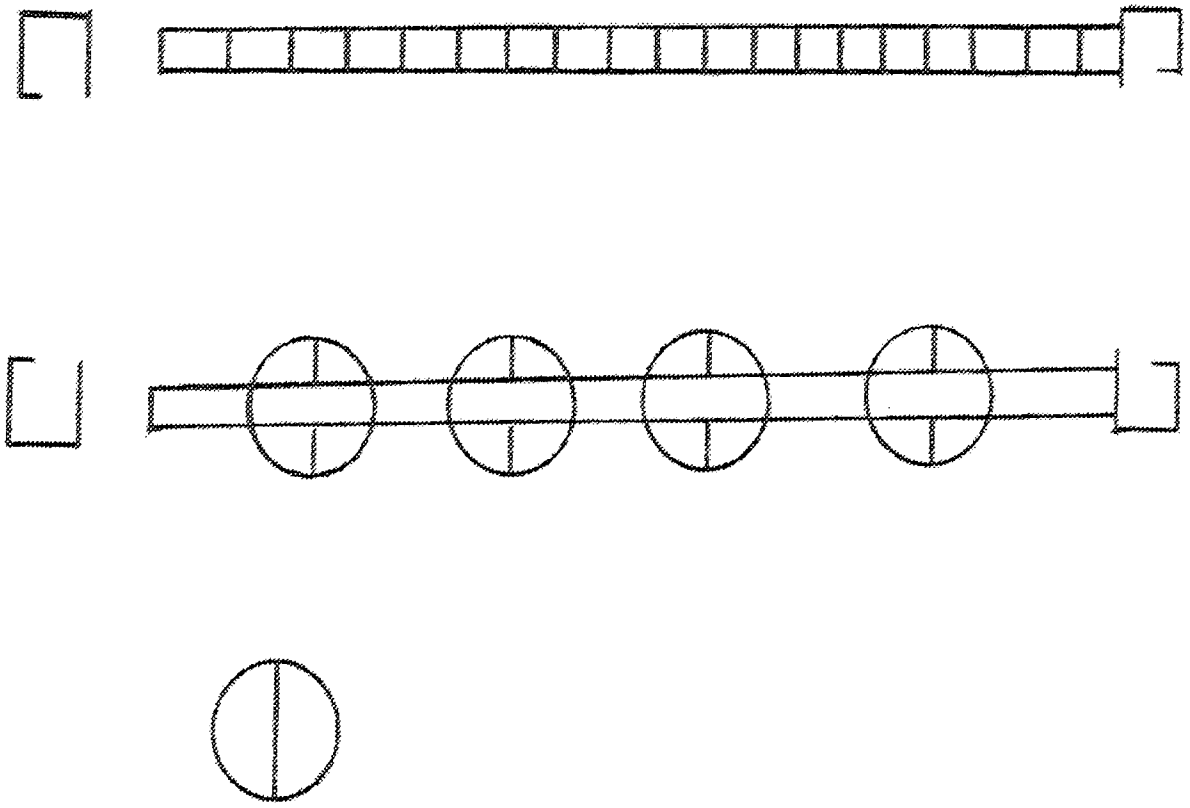
FIG. 26 shows alternative fabric bra straps and/or back bands with hooks that open/close or are removable at one or both ends.

FIGS. 25 and 26 show alternative fabric bra straps and/or back bands. In FIGS. and 26, decorative adjuster slides that look like jewelry are included to adjust the strap/band. Other slides can be added for embellishment. They can match the adjuster slide or be mixed and matched to suit a person's individual style. So, one slide will function to adjust the strap/band, making it shorter or longer, while the other slides are for aesthetics. A person can mix and match slides and put as many on the strap/band as desired or can simply use the adjuster slide, but from a design point of view, the adjuster slide may not always end up at a desired location after adjustment, so additional slides can be used to balance off the design.

FIG. 25 shows alternative fabric bra straps and/or back bands with decorative slides that attach to the strap/band. Here, the hooks may be permanently attached to the strap/band, and the decorative slides may be attached to the strap/band, e.g., using the opening on the center bar. These straps are worn vertically over the shoulders attaching to the front and back of the bra or garment as well as horizontally as a back band, attaching to the left and right side of the bra, securing the bra across her back. They have loops on the reverse side of the strap-band in order to attach the straps to the band. Hooks, are permanently attached to both ends of the strap-band. The decorative slides can only attach to the strap-band by having a small slit or opening the back of the slide. By inserting the fabric band through the opening on the bar of the slide, the slide will stay on the fabric strap-band. While the slides are decorative, one slide is permanently attached to the strap-band which functions as an adjuster slide to make it longer or shorter while the other slides care decorative and interchangeable and can be mixed and matched.

FIG. 26 shows alternative fabric bra straps and/or back bands with hooks that open/close or are removable. Here, one or both hooks may open/close or remove to allow decorative sliders to slide on the strap/band. These straps are worn vertically over the shoulders attaching to the front and back of the bra or garment as well as horizontally as a back band, attaching to the left and right side of the bra, securing the bra across her back. They have loops on the reverse side of the strap-band in order to attach the straps to the band. The hooks can detach from the strap and band to add decorative slides that slide onto the strap or band, then the hook is reattached to the strap or band. There are two ways of adding decorative slides: (1) the fabric strap or band can open by a snap, or other means, and the hooks can be taken on or off; or (2) the hooks can be made so they can be removed from the strap by a slit, or opening, in the hook that allows the strap to attach to the hook. This allows a woman to add decorative slides that have a horizontal bar across the back of the slide. The slides can be any decorative design. One slide is permanently attached to the strap which functions as an adjuster to make it longer or shorter while the other slides are decorative and interchangeable and can be mixed and matched.

Because the bridge segment is a piece of jewelry, a person can modestly and tastefully wear low cut or plunging necklines, e.g., without having to safety pin the top closed. The jeweled, or embellished, bridge will blend in and become a part of the outfit.

Because the band is also jewelry, a person can comfortably wear low back, or no back, garments, while maintaining support from a comfortable bra that fits properly. The jeweled, or embellished, band will blend in and become a part of the outfit.

Because the bra straps are also jewelry, a person can wear fashions that show shoulders, such as halter tops, strapless tops, one shoulder tops, spaghetti straps, off-the-shoulder sweaters, even wedding gowns, etc., while maintaining support from a comfortable bra that fits properly. The jeweled bra straps will blend in and become a part of the outfit.

It should be noted that the sectional bra can be worn strapless, can be worn with fixed-length straps and/or bands, with sectional straps and/or bands, with a sectional bridge segment, or in other configurations. The various components of the sectional bra can be sold separately, including cup components, bridge components, strap components, band components, etc. In other words, it is conceivable that a person could purchase individual cups, a bridge, and the components for whatever strap/band configuration is desired (e.g., back band only, back band with one shoulder/neck strap, back band with two shoulder/neck straps, multi-way connectors to make other designs, sections with ornaments, sections without ornaments, sections with jewels, sections without jewels, etc.). For that matter, the cups literally could be sold separately and do not even have to match (e.g., different sizes/padding to accommodate asymmetry, different designs, different colors, etc.). In other words, this could be a fully customizable bra system, e.g., one could purchase cups that are individually fit, purchase an appropriate-width bridge, and have custom fit band/straps. Cups may be sold in numerous cup sizes/types, making it possible for persons of all sizes (e.g., small and large busted, petite and plus size) to wear plunging necklines, low back garments, and exposed shoulders with a comfortable bra that is secure and fits properly.

As with the sectional bra straps/bands, the bra system may be sold as a kit, with additional pieces purchased separately. Additional decorative sections or components will be sold separately and could include limited edition pieces, e.g., during the holidays or certain times of the year.

Due to its beauty and sophistication, this bra can be worn as outerwear and thus becomes an integral part of an outfit, allowing a woman to modestly and comfortably wear fashions that have a plunging neckline, low back or show her shoulders. It opens the door to the entire world of fashion to women of all shapes and sizes.

While most specialty bras are made for small busted women, this bra will be constructed so larger busted women can also enjoy wearing fashions that, up until now, might only have been worn by smaller busted women. Thus, this bra, and accessories, has been designed by the inventor to solve her own frustrating fashion problems and as a result of her problems, she has helped thousands of other women from all over the world with the same problem.

With bra straps that are connected in sections, a woman can personally adjust the size of these bra straps. The length or size of bra straps can change depending upon the style bra or outfit a woman wears them with. So, being able to easily adjust the size is an important feature for all women.

Another feature of the jewelry, bra straps, band, and bridge, is that they are made of materials that will not snag fabric. All clothing is safe to wear with our jewelry whether it is lace, chiffon or knits.

In conclusion, from five years of experience of designing and manufacturing an entire line of "snag free" jewelry and bra straps and working personally with her customers fitting them to bras, bra straps and jewelry, this inventor has found that there is an important need that has to be filled. Sizing of bras, bra straps and jewelry is a frustrating problem that she wants to improve upon and correct for herself and other women.

In contrast to more traditional bra designs, this bra is designed to be worn with any style garment and can be worn as outerwear thus becoming an integral part of the outfit.

The back band can show, it can be lengthened and shortened, and detached and replaced with a different style band to match any outfit. Sizing is no longer a frustration.

The bridge can show and can be detached and replaced with a different style bridge to match any outfit. No more pinning your top.

The bra straps can show, they can be lengthened or shortened, and detached and replaced with different style bra straps to match any outfit. No More strapless bras that fall down and No More worrying about your ugly bra straps showing.

The cups will also be made so they can be shown through sheer or see-through material. Since the cups are removable, they can also be mixed and matched with other cups.

Coordinating Jewelry

The issues that existed with prior art bra straps also exists with coordinating jewelry, i.e., everything needs to be made in sizes to fit different size women. Wrists, ankles, necks, and hips all come in a multitude of shapes and sizes, so the jewelry that is worn around a wrist, ankle, neck and hips also need to be sized to fit. Therefore, coordinating jewelry items such as bracelets, anklets, necklaces, and belts will be made up of the same or similar components as the bra straps, back band, and bridge, i.e., flexible chain segments that are interconnected by rigid connector segments. This allows people to easily size their own jewelry to fit them personally.

In some cases such as bracelets and anklets, it may be necessary or desirable to include smaller and/or shorter components to allow for finer length adjustments. For example, a bracelet may be sized in quarter-inch increments with a base size of around 5.5 inches.

Similarly, in some cases such as belts, it may be necessary or desirable to include larger and/or longer components, e.g., for strength and/or so that fewer components are needed to form the jewelry. For example, a belt may be sized in one-inch increments with a base size of around 25 inches and may include larger components for added strength.

Jewelry items can be formed in a variety of configurations. For example, jewelry items can be formed as a continual circle with no apparent beginning or end (i.e., with the two ends connected seamlessly to one another). Alternatively, one end of the item may have a hook permanently affixed to the underneath of a rigid connector segment for selectively coupling at an intermediate point along the item so as to leave a portion of the item hanging; preferably, the hook cannot be seen as it is hidden under the solid rigid connector making the connection on this item seamless and unnoticeable. Alternatively, one end of the item may be connected to a "Y" or "V" connector included at some point along the length of the item (e.g., at the other end or at an intermediate point); a "Y" connector used in such a configuration would allow additional segments to be hung from the "Y" connector. Of course, other configurations are possible using the types of sectional components described herein.

Thus, coordinating jewelry items such as belts, bracelets, anklets, and necklaces can be provided using mix-and-match components that can be purchased over time as needed or desired. For example, a person might purchase the components for a bracelet and later purchase the components for a matching necklace. Furthermore, just like the sectional bra straps and bands, the sectional jewelry items can be reconfigured, e.g., to increase or decrease the length of the item and/or to customize for a particular outfit. Because the length of the jewelry items can be adjusted, purchasers no longer have to worry about gaining or losing weight because they can easily change the length of the items accordingly and so they are not wasting their money if they buy an item and later have to lengthen or shorten it.

Figure 36:
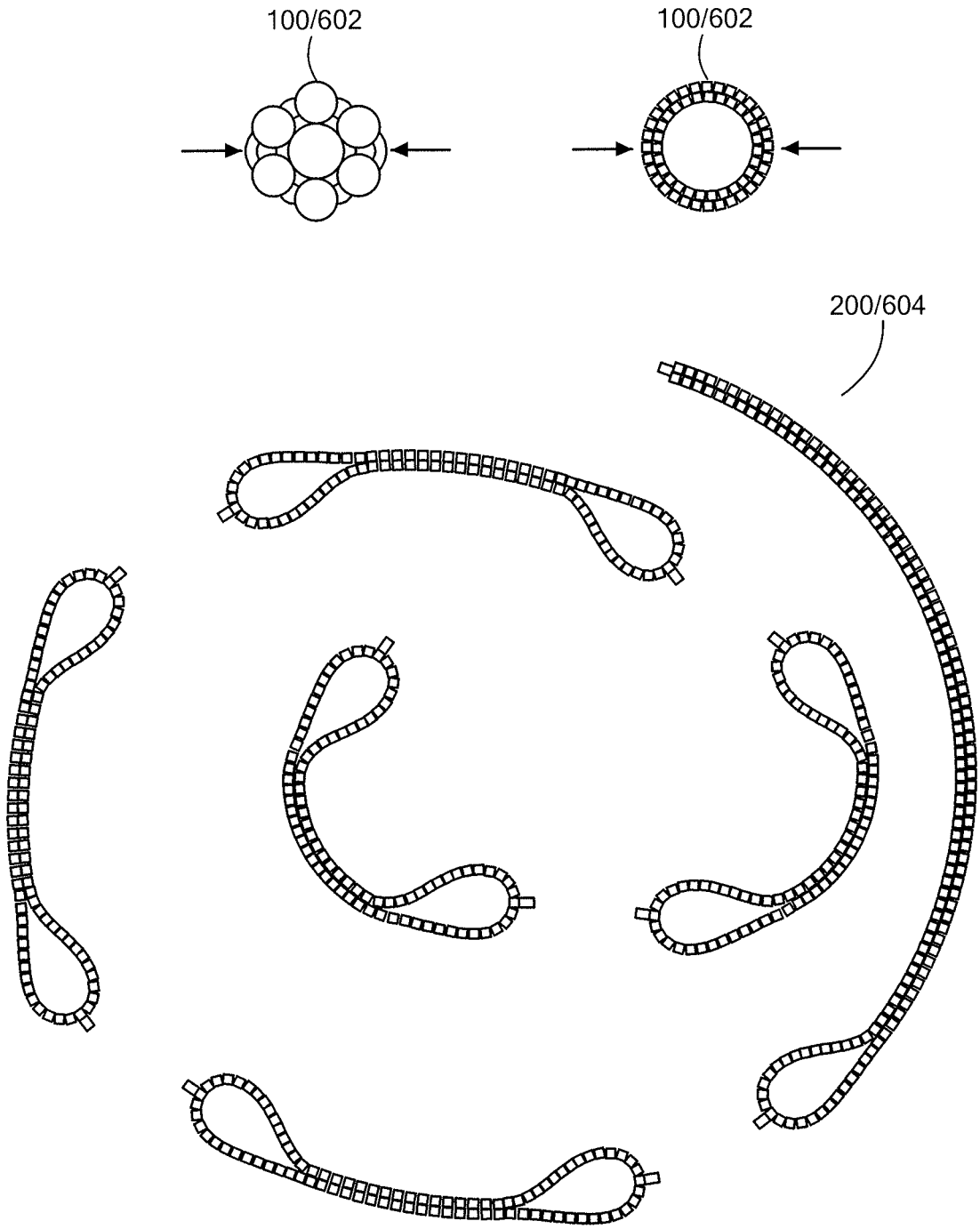
FIG. 36 shows exemplary sectional components for forming coordinating jewelry items, in accordance with various exemplary embodiments.
Figure 37:
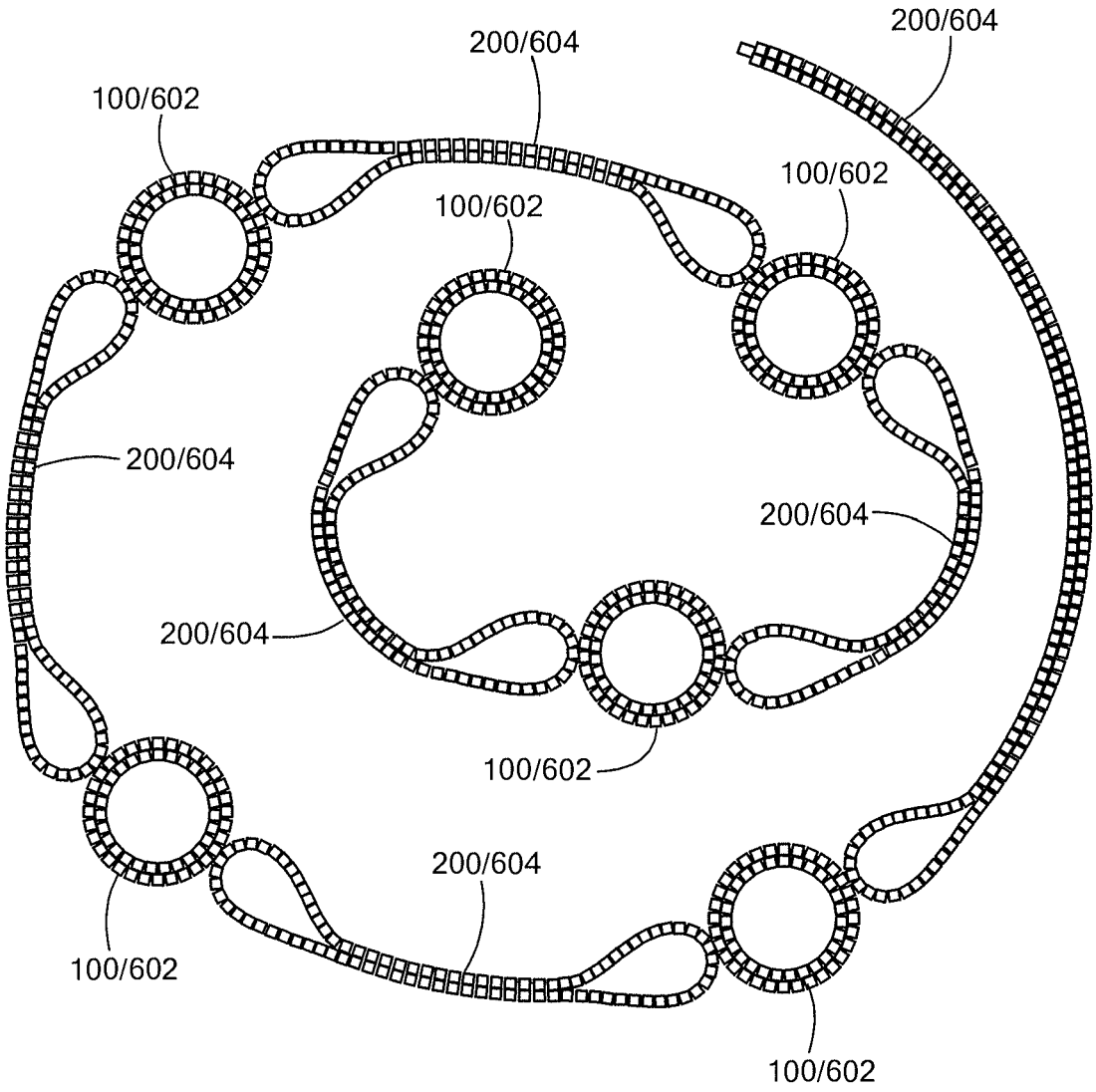
FIG. 37 shows a completed coordinating jewelry item using ring connector segments, in accordance with a first exemplary embodiment.
Figure 38:
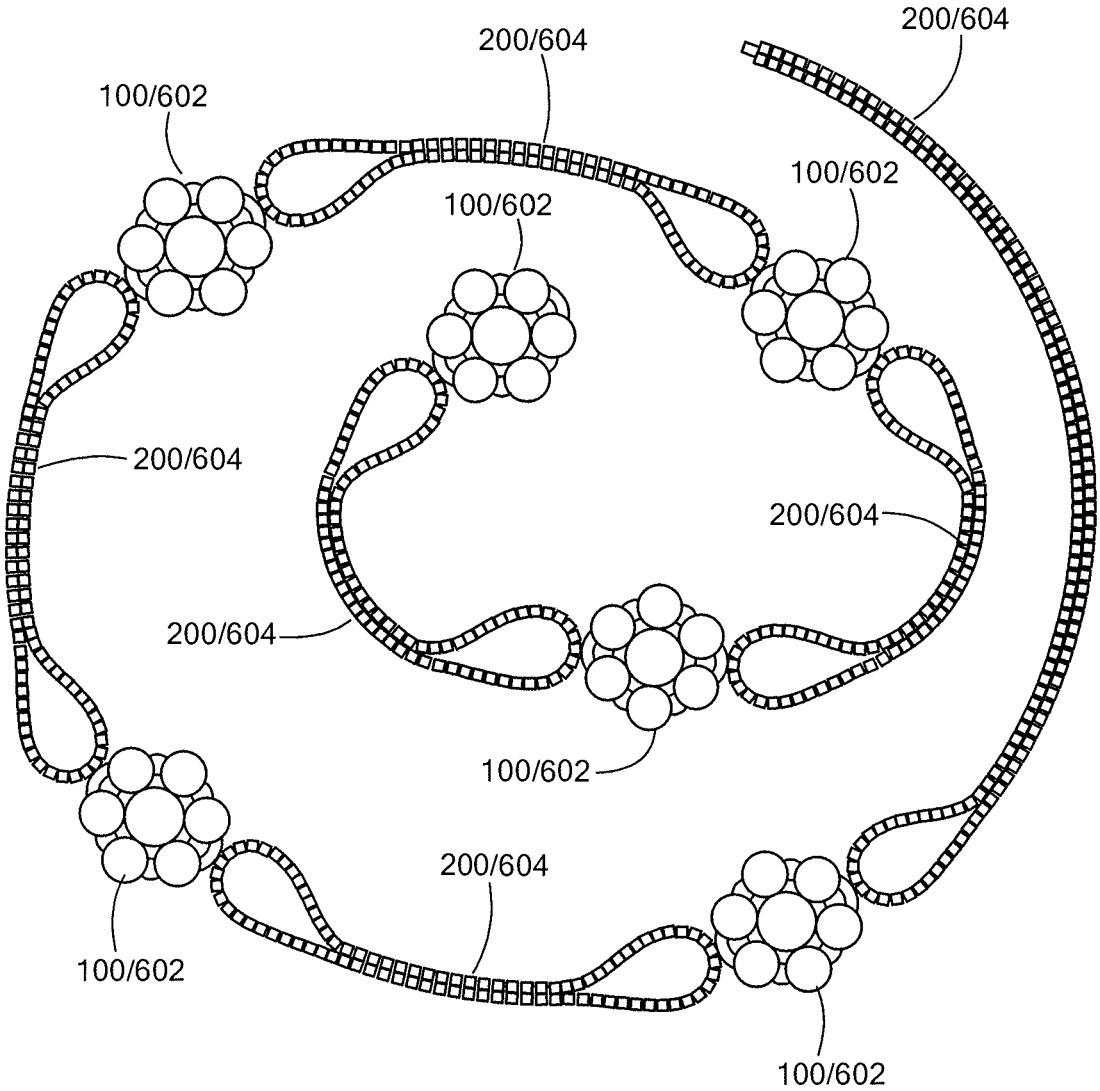
FIG. 38 shows a completed coordinating jewelry item using flower connector segments, in accordance with a second exemplary embodiment.
Figure 39:
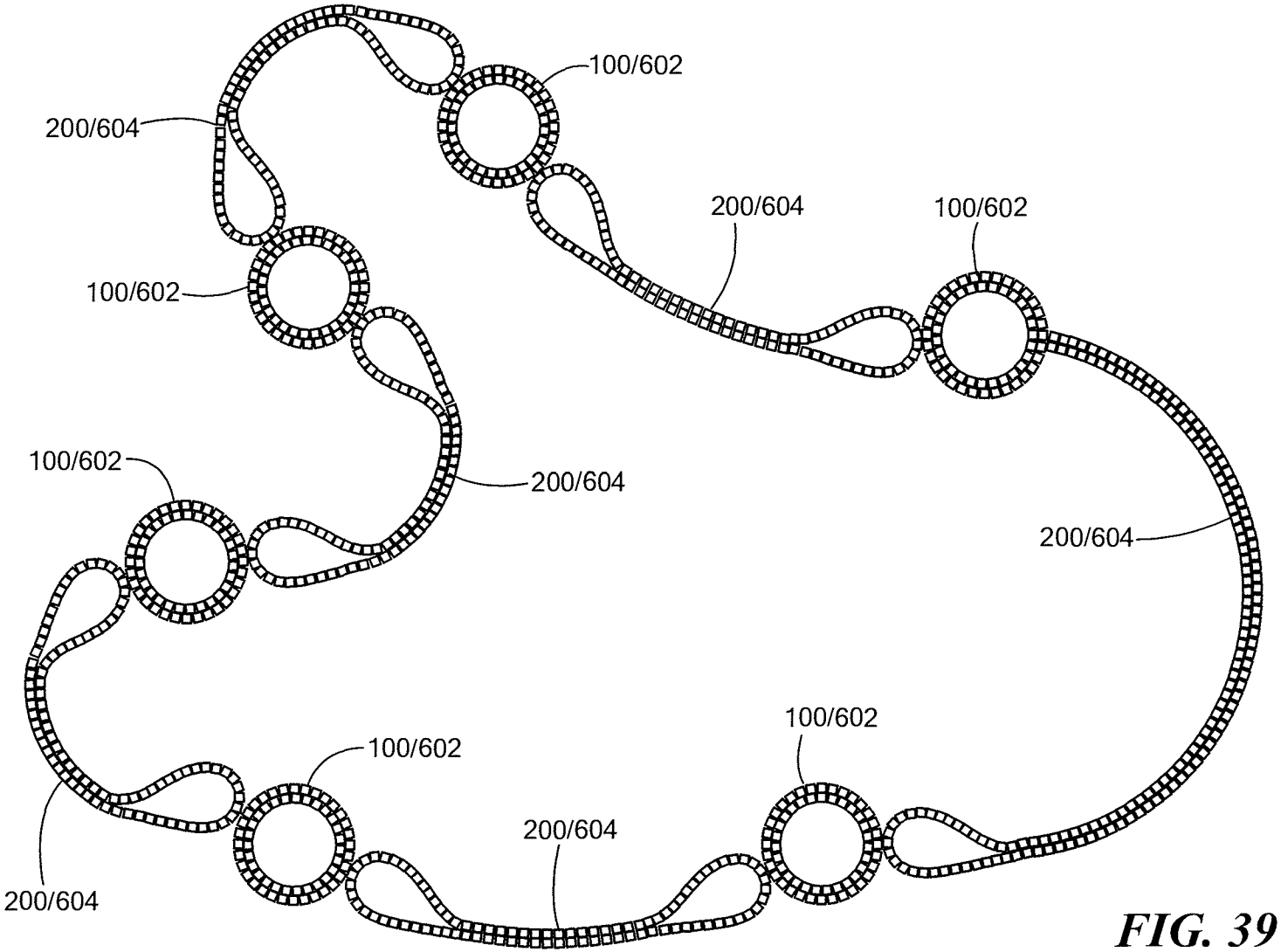
FIG. 39 shows the completed coordinating jewelry item with ring connector segments from FIG. 37 with the ends interconnected to form a continual circle with no beginning or end, in accordance with a specific exemplary embodiment.

FIG. 36 shows exemplary sectional components for forming coordinating jewelry items, in accordance with various exemplary embodiments of the present invention. The components here include male-male flexible chain segments and two styles of female-female rigid connector segments (a flower and a ring). FIG. 37 shows a completed coordinating jewelry item (e.g., a belt) using ring connector segments, in accordance with a first exemplary embodiment. FIG. 38 shows a completed coordinating jewelry item (e.g., a belt) using flower connector segments, in accordance with a second exemplary embodiment. FIG. 39 shows the completed coordinating jewelry item with ring connector segments from FIG. 37 with the ends interconnected to form a continual circle with no beginning or end, in accordance with a specific exemplary embodiment.

Alternative Embodiments

Figure 34:
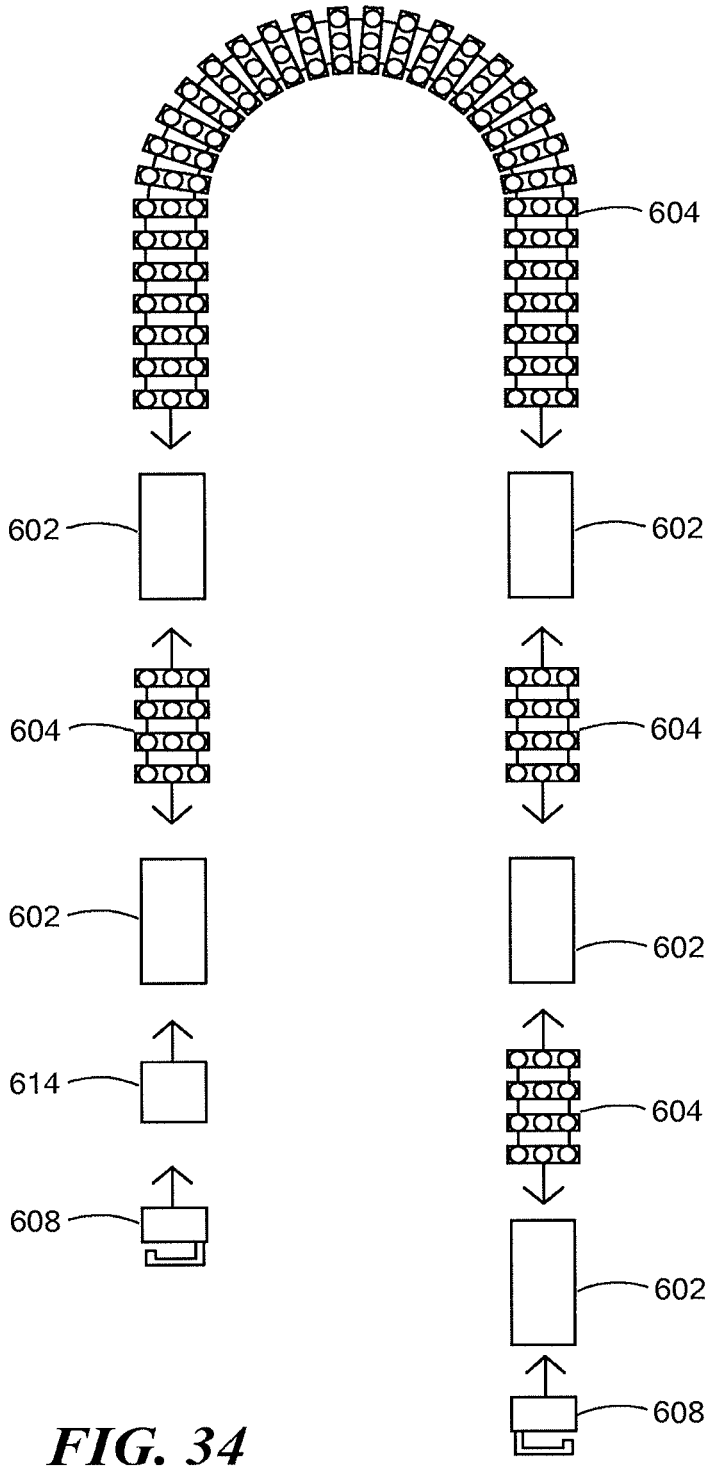
FIG. 34 shows an exemplary strap/band configuration in which a half-inch male-female connector segment is used.

It should be noted that, while the sectional jewelry items described above are formed predominantly from alternating chain and two-way connector segments, with the chain segments having one type of coupling element at each end and the two-way connector segments having another type of coupling element at each end, embodiments of the present invention additionally may include two-way segments having a male coupling element at one end and a female coupling element at the other. For example, a system may include small male-female chain and/or connector segments (e.g., 0.5-inch) to be used in making half-inch adjustments in some configurations. FIG. 34 shows an exemplary strap/band configuration in which a half-inch male-female connector segment is used. Specifically, the strap/band configuration includes, from left to right, a half-inch male fastener segment 608, a half-inch M-F segment 605, a one-inch F-F connector segment 602, a one-inch M-M chain segment, a one-inch F-F connector segment 602, a ten-inch M-M chain segment 604, a one-inch F-F connector segment 602, a one-inch M-M chain segment 604, a one-inch F-F connector segment 602, a one-inch M-M chain segment 604, a one-inch F-F connector segment 602, and a half-inch male fastener segment 608.

Figure 35:
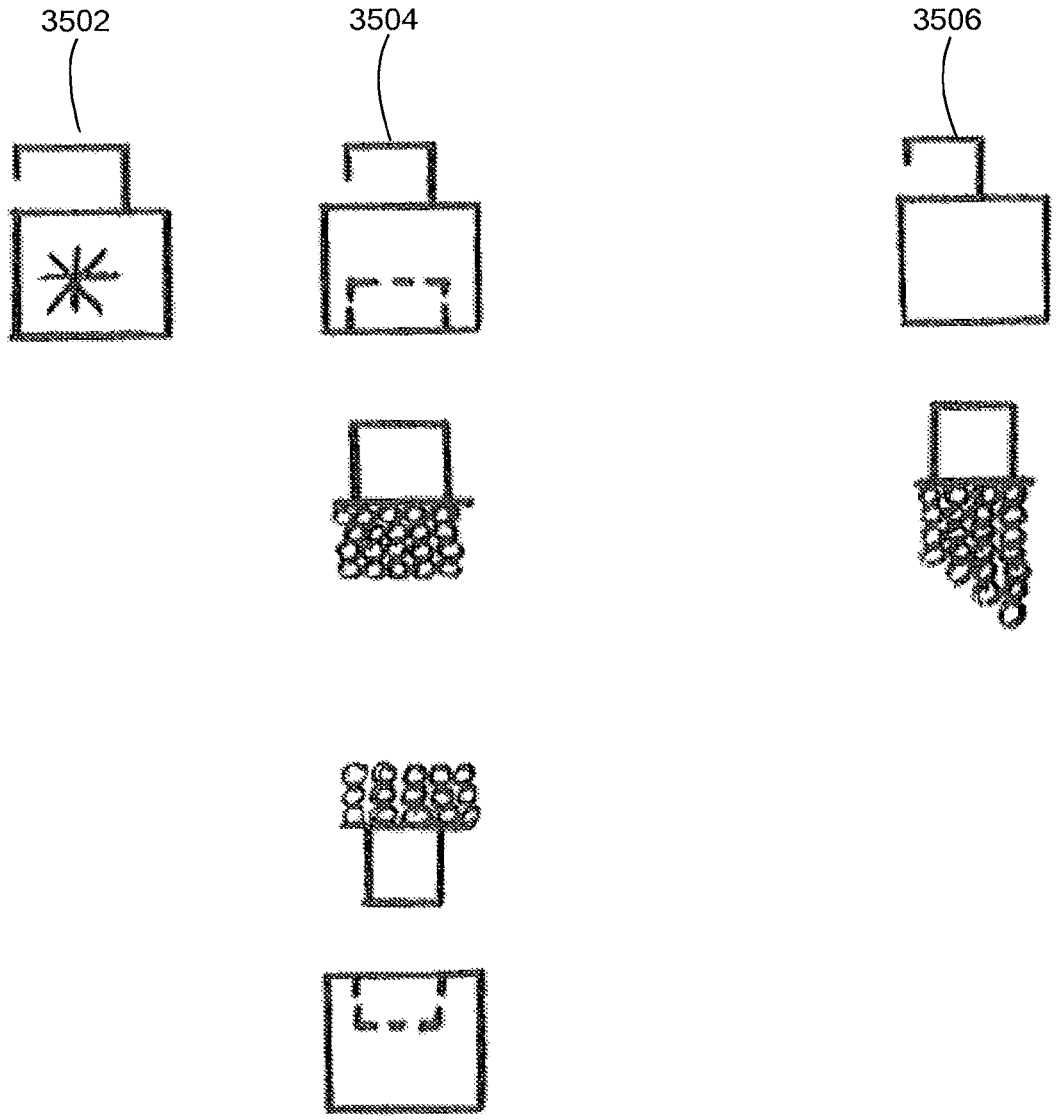
FIG. 35 schematically shows some exemplary decorative segments, in accordance with an exemplary embodiment of the present invention.

It also should be noted that a system may include decorative segments having a fastener and various decorative elements. FIG. 35 schematically shows some exemplary decorative segments, where segment 3502 is essentially a rigid fastener segment with no other coupling elements (this segment could have additional embellishments, such as dangling chains); segment 3504 includes a fastener segment and one or more chain/connector segments and terminates with a specially adapted rigid connector-type segment with a single coupling element; and segment 3506 includes a fastener segment and perhaps one or more chain/connector segments (not shown) and terminating with a specially adapted chain segment. Such decorative segments may be hung from loops on a bra or other garment. For example, in the bra shown in FIG. 32, decorative segments could be hung from one or more of the loops along the bottom edge of the bra cups, wings, and/or back band.

It also should be noted that exemplary segment lengths discussed above represent the length added to the jewelry item and not necessarily to the actual length of the segment. For example, a 1-inch male-male chain segment might be almost two inches in overall length including the male portions that fit into the female coupling elements.

It also should be noted that aspects of the sectional bra, such as separate cups and/or loops for attaching strap(s), back band(s), bridge, and/or decorative items, may be included in other similar garments such as bathing suit tops, dresses/gowns, tops (including tops with integral bras), etc.

It should be noted that headings are used above for convenience and should not be construed to limit the invention.

The present invention may be embodied in other specific forms without departing from the true scope of the invention. Any references to the "invention" are intended to refer to exemplary embodiments of the invention and should not be construed to refer to all embodiments of the invention unless the context otherwise requires. The described embodiments are to be considered in all respects only as illustrative and not restrictive.

What is claimed is:

1. A bridge for connecting a left bra cup and a right bra cup of a multi-configuration bra, each bra cup including a plurality of bra loops along an inner edge of the bra cup, the bridge comprising:

a bridge body configured for positioning between the inner edges of the left and right bra cups;

a plurality of left bra hooks along a left edge of the bridge body, each left bra hook configured to engage with exactly one bra loop of the plurality of bra loops on the inner edge of the left bra cup; and a plurality of right bra hooks along a right edge of the bridge body, each right bra hook configured to engage with exactly one bra loop of the plurality of bra loops on the inner edge of the right bra cup.

2. A bridge according to claim 1, wherein the bridge body is embellished.

3. A bridge according to claim 1, wherein the bridge body is fabric.

4. A bridge according to claim 1, wherein the bridge body includes a plurality of bra loops for attaching at least one bra strap with bra hook to the bridge body.

5. A bridge according to claim 1, wherein the bridge body and the bra hooks are sectional jewelry components that attach together to form the bridge.

6. A bridge according to claim 5, wherein:

the bridge body includes at least two female sectional jewelry coupling elements positioned for attaching the bra hooks between the two bra cups; and each bra hook includes a male sectional jewelry coupling element that attaches to a female sectional jewelry coupling element of the bridge body.

7. A bridge according to claim 5, wherein:

the bridge body includes at least two male sectional jewelry coupling elements positioned for attaching the bra hooks between the two bra cups; and each bra hook includes a female sectional jewelry coupling element that attaches to a male sectional jewelry coupling element of the bridge body.

8. A bridge according to claim 5, wherein:

the bridge body includes a plurality of sectional jewelry coupling elements positioned for attaching at least one bra strap.

* * * * *